US006581727B1

(12) United States Patent
Tokuno

(10) Patent No.: US 6,581,727 B1
(45) Date of Patent: Jun. 24, 2003

(54) METHOD OF AND APPARATUS FOR SERVING MERCHANDISE ITEMS IN A RESTAURANT WITH A ROTARY CATERING TABLE SYSTEM, AND MERCHANDISE ITEM MANAGEMENT SYSTEM FOR SUCH RESTAURANTS

(75) Inventor: Nobuo Tokuno, Ishikawa-gun (JP)

(73) Assignee: Japan Crescent Co., Ltd., Ishikawa-ken (JP)

( * ) Notice: Subject to any disclaimer, the term of this patent is extended or adjusted under 35 U.S.C. 154(b) by 152 days.

(21) Appl. No.: 09/780,422

(22) Filed: Feb. 12, 2001

(30) Foreign Application Priority Data

| | | |
|---|---|---|
| Feb. 14, 2000 | (JP) | 2000-034521 |
| Jul. 12, 2000 | (JP) | 2000-210923 |
| Sep. 6, 2000 | (JP) | 2000-269661 |
| Sep. 6, 2000 | (JP) | 2000-269662 |
| Oct. 11, 2000 | (JP) | 2000-310150 |

(51) Int. Cl.[7] ..... E04H 3/04
(52) U.S. Cl. ..... 186/50; 186/49
(58) Field of Search ..... 186/42, 49, 50, 186/51

(56) References Cited

U.S. PATENT DOCUMENTS

| | | | | |
|---|---|---|---|---|
| 4,349,086 A | | 9/1982 | Yamada | |
| 4,609,092 A | * | 9/1986 | Takai | 198/367 |
| 4,765,440 A | * | 8/1988 | Tashman | 186/44 |
| 4,977,823 A | | 12/1990 | Kuwahara | |
| 5,477,778 A | | 12/1995 | Kuwahara | |
| 5,562,183 A | * | 10/1996 | Naramura | 186/49 |
| 6,145,628 A | * | 11/2000 | Tanaka | 186/50 |

* cited by examiner

*Primary Examiner*—Dean J. Kramer
(74) *Attorney, Agent, or Firm*—Wenderoth, Lind & Ponack, L.L.P.

(57) ABSTRACT

An improved serving method and apparatus are disclosed for use in rotary catering table equipment having a rotary conveyer (22) on which merchandise (e.g., sushi) items (14) are conveyed around. A freshness managing member (48) is used to automatically alert to the presence of a merchandise item on the rotary conveyer that is deteriorating in freshness upon a given lapse of time after supply. Shortage may also be detected, displayed and indicated by a processing device (70) in combination with mechanisms (32, 38) that determine where on the conveyer and which types of merchandise items are becoming short in number. Also disclosed are a merchandise item stocker (34) and a feeder for automatically serving the rotary conveyer (22) with merchandise items, which may be operated with a merchandise management system (80) in which an ordering mechanism (78) based on data from a managing device (74) automatically orders needed merchandise materials by types from member suppliers (76).

75 Claims, 29 Drawing Sheets

METHOD OF AND APPARATUS FOR SERVING MERCHANDISE ITEMS IN A RESTAURANT WITH A ROTARY CATERING TABLE SYSTEM, AND MERCHANDISE ITEM MANAGEMENT SYSTEM FOR SUCH RESTAURANTS

BACKGROUND OF THE INVENTION

1. Field of the Invention

The present invention generally relates to a restaurant or eating establishment of the type provided with a rotary catering table system or equipment having a rotary conveyer lane disposed in a top area of a base stand and on which merchandise items are conveyed around. In particular, the invention relates to a method of and apparatus for serving merchandise items whereby merchandise items on the rotary conveyer lane that are becoming short of supply in type and number can be automatically replenished, the presence of merchandise items that are deteriorating in freshness can be alerted to and in turn merchandise items that are abundant in type can be served efficiently. The present invention also relates to a merchandise item management system that can automatically manage merchandise items according to such merchandise supply by a method and in an apparatus as described and can automatically order needed merchandise item materials from suppliers.

2. Description of the Prior Art

So far, in a restaurant or eating establishment in which a rotary catering table system is installed, merchandise items which are typically "sushi" items have commonly been conveyed and served each as placed on a merchandise item tray to pass around a loop on the rotary conveyer path or lane (hereinafter simply referred to as rotary conveyer).

In serving merchandise items, it has been the practice to preliminarily distribute merchandise items of several types with each type of merchandise items in a given number throughout the rotary conveyer that is moving and turning round. The merchandise items reduced in number as they are taken by guests and have thus become short in number on the rotary conveyer are checked for each type by an operator in glancing over the entire area of the rotary conveyer. For each type that is becoming short, fresh merchandise items are prepared each time the shortage is seen, and are replenished on the rotary conveyer.

Also, when merchandise items are so replenished, it is often the case that enough space is not left in the area on the rotary conveyer where merchandise item trays are lacking.

It has then been the traditional practice for the operator to temporarily hold up the succeeding merchandise item tray or trays by hand to create enough space for supply and then to supply the space with a plurality of fresh merchandise item trays of a given merchandise item type.

To improve the servability of merchandise items, it has been commenced to use a processing apparatus such as a computer and to display on a monitor merchandise items to be replenished for indication to an operator.

Also, in order for a sushi merchandise item to be eaten with gusto, it has been known to be optimum if its "shari" (boiled and vinegared rice) is at body temperature (a temperature around 25 to 35° C.) and its "neta" (material) such as "sashimi" (a slice of raw fish) is cold in temperature.

Also, to manage freshness of sushi merchandise items, it has been the conventional practice to rely on the visual observation by an operator. And, if sushi merchandise items are found that remain uneaten by guests for long and are thus so reduced in freshness that their "neta's" are drying and tend to be dehydrated and their "shari" becomes cold, they are withdrawn or recovered.

Also, to ease checking a charge for merchandise items taken by a guest, it has in recent years become common to fit each merchandise item with an ID medium having merchandise item data such as a price of a merchandise item stored therein and to read the merchandise item data from the ID medium using a reader.

Also, in managing merchandise items in a restaurant, it has been the practice that its owner or a person in charge manages sales for merchandise items every day and in the next morning goes to a market to get fresh cooking materials such as fresh raw fish as needed type by type and consumables such as soy sauce each time or calls to suppliers to have them delivered each time.

As mentioned above, to identify what type of merchandise items is becoming of short supply, insofar as the need has so far existed as mentioned above for each individual operator to glance over the entire crescent chain conveyer, it is found to be difficult for an operator, especially to an unskilled operator, to seize in a moment what type of merchandise items is becoming short. This has become a problem.

Also, in the process of replenishing merchandise items, supplying a plurality of merchandise item trays of one given merchandise item type simultaneously at a site makes a series of offered merchandise items less diversified, and creates the tendency for only merchandise items of that one given type to continue to be conveyed passing around. A situation then arises that a guest must wait for a long time before a merchandise item that he favors arrives in front and is thus prevented from enjoying his dining experience. This has been found to leave much to be desired as for the turnover of guests.

Also, in determining types of merchandise items to be offered, reliance has been made wholly on the operator's rule of thumb. As a result, there may be a failure to offer merchandise items in accord with the season, time zone and guest class, thus creating the problem that the sales figures do not rise as much as expected.

Also, if a processing apparatus is used to determine types of merchandise items, the operator's rule of thumb must be relied on to make entry in the processing apparatus. Consequently, it has still been difficult to offer merchandise items well in accord with the season, time zone (i.e. time of day) and guest class.

Also, if the processing apparatus is used to indicate the types of merchandise items to be replenished, displaying them on the monitor requires an operator to prepare them upon checking on the monitor, to look for spaces to be supplied with them on the rotary conveyer and then to distribute them in those spaces. As a result, considerable skill is still necessary, namely in the two checking operations to check on the monitor and to look for the spaces. Thus, an unskilled operator cannot raise his working efficiency in any way and this has presented a problem, too.

Also, as sushi merchandise items are being conveyed to pass around on the rotary conveyer they lose their freshness as time elapses so that their neta's are drying and tend to be dehydrated and their shari becomes cold. As a consequence, they become less tasty to eat over time, and this has become a problem, too.

For this reason, trays loaded thereon with those sushi merchandise items deteriorating in freshness with neta's loosing moisture and shari loosing warmth are withdrawn. In withdrawing such trays, while a practice has been made of observing the length of time or the number of times they are passed around on the rotary conveyer as suited according to types of merchandise items, changes in temperature and humidity by season have required operators to learn and master as a rule of thumb such lengths of time and numbers of times that are optimum depending on the season, which has made operations of withdrawal very troublesome to an operator who is less experienced. Also, a sushi items if left to turn around for a length of time or a number of times in excess of a threshold extent and then eaten may even hygienically impose a danger of food poisoning on guests. These have been recognized to be problems, too.

Also, in managing and especially laying merchandise items in a restaurant, there also remains the inconvenience that its owner or a person in charge must go to a market to get cooking materials as needed type by type and each time or make calls to suppliers to have them delivered each time.

BRIEF SUMMARY OF THE INVENTION

It is accordingly an object of the present invention to provide a method of and apparatus for serving merchandise items which method and apparatus enable merchandise items that are becoming short in supply on the rotary conveyer to be automatically replenished on the rotary conveyer.

It is also an object of the present invention to provide a method of and apparatus for serving merchandise items which method and apparatus enable an alert as to merchandise items that are deteriorating in freshness.

It is also an object of the present invention to provide a method of and apparatus for serving merchandise items which method and apparatus enable merchandise items abundant in type to be served efficiently.

It is a further object of the present invention to provide a merchandise item management system that can automatically manages merchandise items according to such merchandise services by a method and in an apparatus as described and can automatically order needed merchandise item materials from suppliers.

In order to achieve these and other objects which will become more readily apparent hereinafter, the present invention in a first aspect thereof provides a method of and an apparatus for serving merchandise items in a rotary catering table system having a rotary conveyer path or lane disposed in a top area of a base stand and on which merchandise items are conveyed around, which method and apparatus are characterized in that a merchandise item stocker is disposed adjacent to the rotary conveyer lane, the merchandise item stocker having a plurality of compartments defined by rows and tiers and adapted to store therein merchandise items classified by type, a merchandise item feeder is disposed adjacent both the stocker and the rotary conveyer lane, the merchandise item feeder being operable to select merchandise item from those stored in the merchandise item stocker and to transfer the selected merchandise item onto the rotary conveyer lane, and by means of the merchandise item feeder, the rotary conveyer lane is served with merchandise items.

In a specific form of embodiment of the present invention in this aspect, a measuring means is used to determine types of merchandise items being conveyed around on the rotary conveyer lane and their respective numbers; and the merchandise item feeder is operative to determine which specified types of merchandise items on the rotary conveyer lane are becoming short of supply each from a specified number, and then to transfer as the selected merchandise item a merchandise item of a type so determined from the stocker onto the rotary conveyer lane.

In a further specific form of embodiment of the present invention in this aspect, a detecting means is used to determine a place on the rotary conveyer lane at which a merchandise item is lacking, and the merchandise item feeder is operative to replenish the place determined on the rotary conveyer lane with a merchandise item from the merchandise item stocker.

In a further specific form of embodiment of the present invention in this aspect, the rotary conveyer lane is provided with a merchandise item supply zone to be served with a merchandise item manually by an operator and a merchandise item recovery zone where to recover a merchandise item that is deteriorating in freshness, each of the zones is provided with a measuring means for determining types of merchandise items with which the supply zone is served and their respective numbers and types of merchandise items recovered in the recovery zone and their respective numbers, respectively, whereby merchandise items turned around on the rotary conveyer lane are managed.

The present invention also provides in a second aspect thereof a method of and an apparatus for serving merchandise item in a rotary catering table system as described, which method and apparatus are characterized in that the rotary conveyer lane is fitted with freshness managing members, the rotary conveyer lane that is fitted with the freshness managing members is served with merchandise items, the freshness managing members being each operable for actuation upon supply with a merchandise item for measuring time elapsing for the merchandise item after supply and each operable to issue a warning upon a predetermined lapse of time after the supply; and by way of such a warning by the freshness managing members, the presence of a merchandise item that is deteriorating in freshness is alerted to.

At this point, it should be noted that the rotary conveyer lane is conveniently formed from a series of conveyer elements.

In a specific form of embodiment of the present invention in the first or second aspect, one of the conveyer elements or one of the freshness managing members is fitted with an ID medium that is capable of registering a type or the like of a merchandise item, a measuring means is disposed adjacent to the rotary conveyer lane, the measuring means being adapted to measure the ID medium and a detecting means is also disposed adjacent to the rotary conveyer lane, the detecting means being adapted to determine the presence or absence of a merchandise item on or above each of the conveyer elements or of the freshness managing members, the measuring means and detecting means are connected to a processing means for indicating a type of merchandise items, the processing means being adapted to determine which specified type of merchandise items on the rotary conveyer lane is becoming short of supply in number each from a specified number, and the rotary conveyer lane is supplied with a merchandise item of a type so determined on a designated conveyer element or freshness managing member.

In this case, advantageously only one of two adjacent such conveyer elements is fitted with the ID medium, thereby reducing the number of the ID media used.

Also, advantageously two adjacent such conveyer elements are fitted with a freshness managing member and a cover member having no freshness managing means attached thereto, respectively, thereby reducing the number of the freshness managing members used.

Also, preferably the warning is issued for each type of merchandise items by emitting a light that varies in flickering time interval, number of light emissions or color depending on types of merchandise items.

Also, each of the freshness managing members is preferably made responsive to lightness in environment of the rotary catering table and is thus made to suspend from issuing a warning in a time zone outside of the business hours of the restaurant in which that environment is dark.

Further, in a specific form of embodiment of the present invention in the first or second form, an ID medium is fitted to a merchandise item tray having a merchandise item placed thereon, the ID medium having a type, price or allowance lapse of time or the like of the merchandise item registered therein.

The present invention also provides in a third aspect thereof a method of and an apparatus for serving merchandise items in a rotary catering table system as described, which method and apparatus are characterized in that the rotary conveyer lane is formed from a series of conveyer elements, a preselected color or pattern is applied to each of the conveyer elements at least on a surface thereof; and each of the conveyer elements is supplied with a merchandise item of the type corresponding to the color or pattern applied thereto, whereby merchandise items abundant in type are efficiently offered to guests.

In a specific form of embodiment in this aspect of the present invention, a color or pattern is applied to each of the conveyer elements by attaching detachably to each of the conveyer elements an identifier having a color or pattern applied to at least a surface thereof.

The present invention also provides in a fourth aspect thereof a method of and an apparatus for serving merchandise items in a rotary catering table system as described, which method and apparatus are characterized in that the rotary conveyer lane is formed from a series of conveyer elements, each of the conveyer elements is fitted with a display plate displaying a particular type of merchandise items, and each of the conveyer elements is supplied with a merchandise item of the type displayed by the display plate fitted thereto, whereby merchandise items abundant in type are efficiently offered to guests.

The present invention also provides in a fifth aspect thereof a merchandise item management system for a plurality of restaurants each provided with a rotary catering table device having a rotary conveyer lane disposed in a top area of a base stand and on which merchandise items are conveyed around, and an apparatus for serving merchandise items which includes: a merchandise item stocker disposed adjacent to the rotary conveyer lane, the merchandise item stocker having a plurality of compartments defined by rows and tiers and adapted to store therein merchandise items classified by type; a measuring means for determining types of merchandise items, which are being conveyed around on the rotary conveyer lane, and their respective numbers to determine which specified type of merchandise items being conveyed around is becoming short of supply in number from a specified number; and a merchandise item feeder disposed adjacent both the stocker and the rotary conveyer lane, the merchandise item feeder being operable to select a merchandise items of the specified type from those stored in the merchandise item stocker and to transfer the selected merchandise item onto the rotary conveyer lane, thereby automatically serving the rotary conveyer lane with merchandise items, the merchandise item management system being operable for execution on or with an information communication network and comprising:

a merchandise item managing means for managing merchandise items to produce management data; and a merchandise item ordering means responsive to the management data from the merchandise item managing means for ordering needed merchandise type by type from a plurality of suppliers, whereby automatically entering data representing a status of supply of merchandise items by the merchandise item feeder in a given restaurant as aforesaid into the managing means in the merchandise item management system directs the managing means automatically to construct such management data as aforesaid and identifying merchandise item materials needed in the restaurant and directs the merchandise item ordering means responsive thereto automatically to order the identified merchandise items type by type from the plural suppliers for delivery thereby of the same to the restaurant.

These and other features, objects and advantages of the present invention will become more readily apparent to those of ordinary skill in the art from the following detailed description of the preferred forms of embodiment thereof as illustrated in the various drawing Figures.

BRIEF DESCRIPTION OF THE DRAWINGS

In the accompanying drawings.

DETAILED DESCRIPTION

An apparatus according to the present invention for serving merchandise items in a rotary catering table system is constructed as set forth below and as shown in FIGS. 1 to 17.

Figure 7:
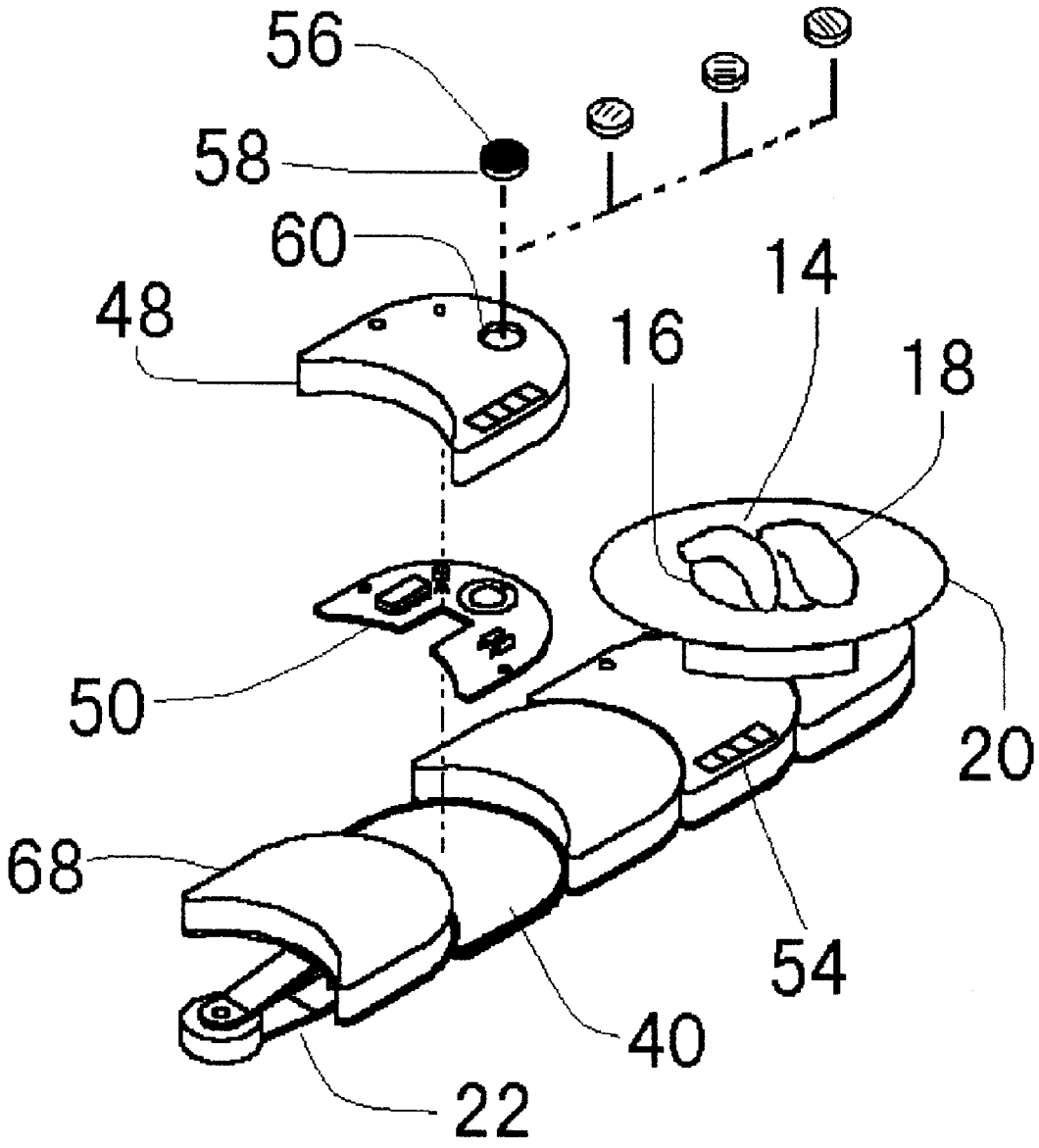
FIG. 7 is an exploded perspective view illustrating a freshness managing member according to the present invention, shown in relation of rotary conveyer elements and a merchandise item loaded tray.
Figure 13:
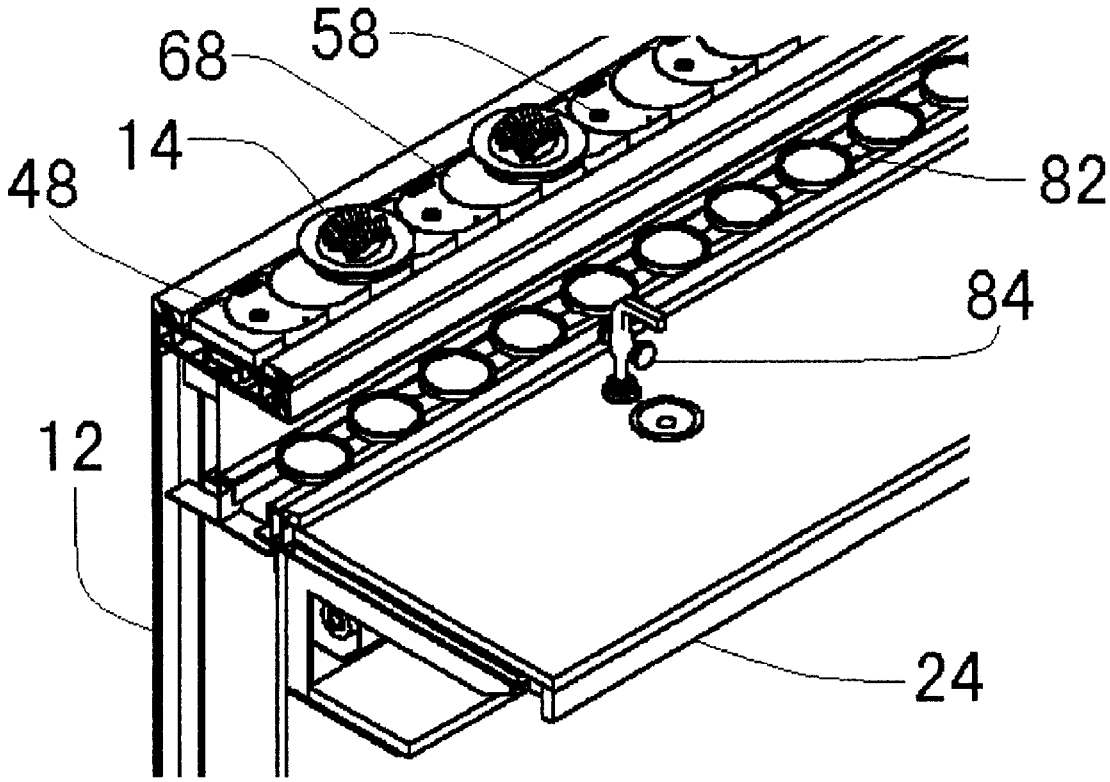
FIG. 13 is a diagrammatic perspective view illustrating a manner of use of freshness managing members according to the present invention.
Figure 14:
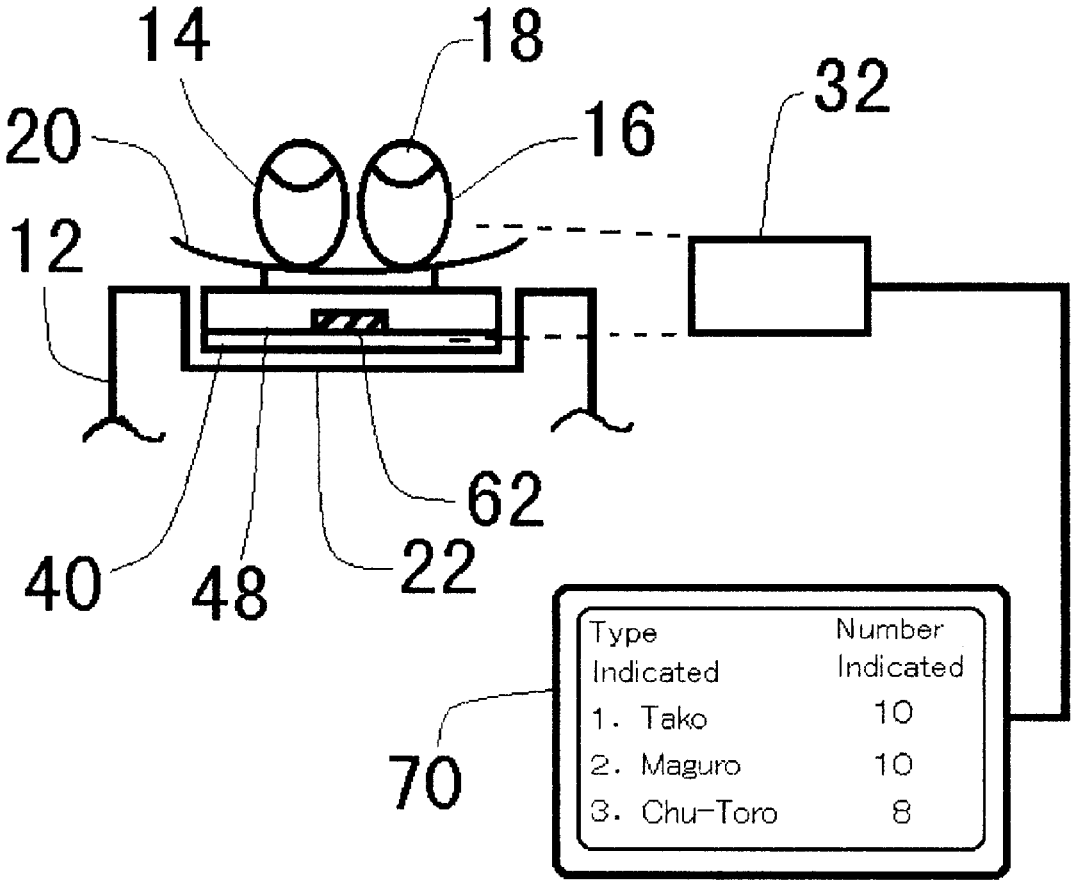
FIG. 14 is a front view of the same.
Figure 15:
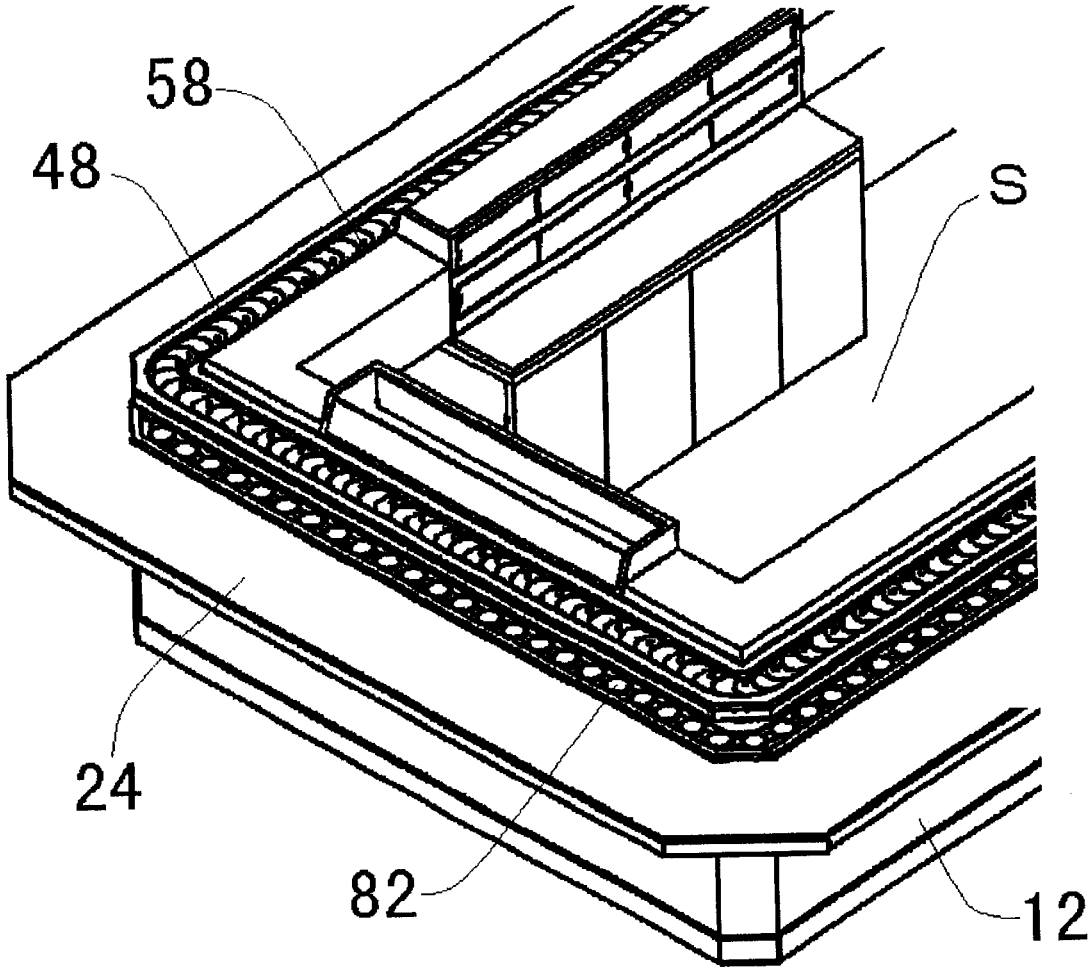
FIG. 15 is a perspective view of essential portions of a rotary catering table system incorporating a merchandise item freshness managing arrangement according to the present invention.

Referring first to FIGS. 13 to 15, a rotary catering table for use with the system in the present invention has a rotary conveyer 22 (also see FIGS. 1 and 2) disposed on a top area of a base stand 12 (FIG. 3) for conveying merchandise item trays 20 (FIG. 7) loaded thereon with merchandise items 14, so they pass around a loop. As illustrated in FIG. 7, the merchandise items 14 here are each a sushi item with shari 16 and a neta 18 such as a piece of sashimi placed thereon. In the rotary catering system, the base stand 12 is shown to have a counter 24 (FIGS. 1, 13 and 15) provided along its outer peripheral edge or rim.

Figure 2:
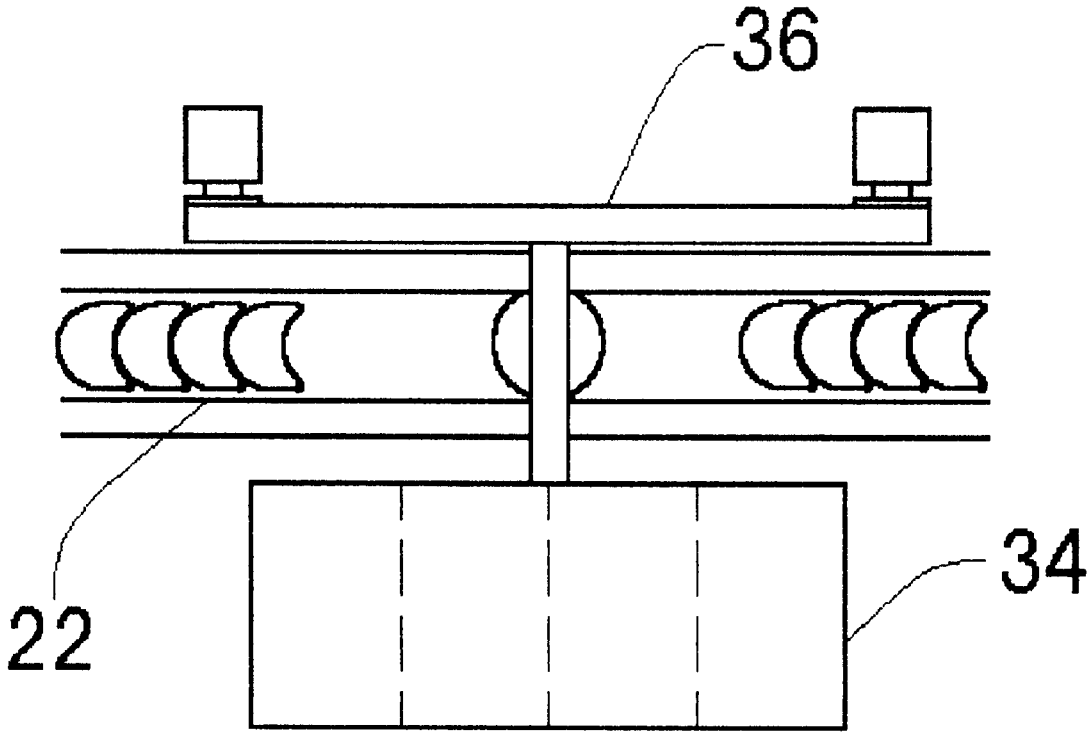
FIG. 2 is an enlarged top plan view of a portion of the system shown, illustrating a merchandise item stocker and a merchandise item feeder in the apparatus shown in FIG. 1.

As illustrated in FIGS. 2 and 14, the merchandise item trays 20 are each conveniently a disposable paper tray, which eliminates the need for washing after use, and is hygienic and easy to handle.

Figure 3:
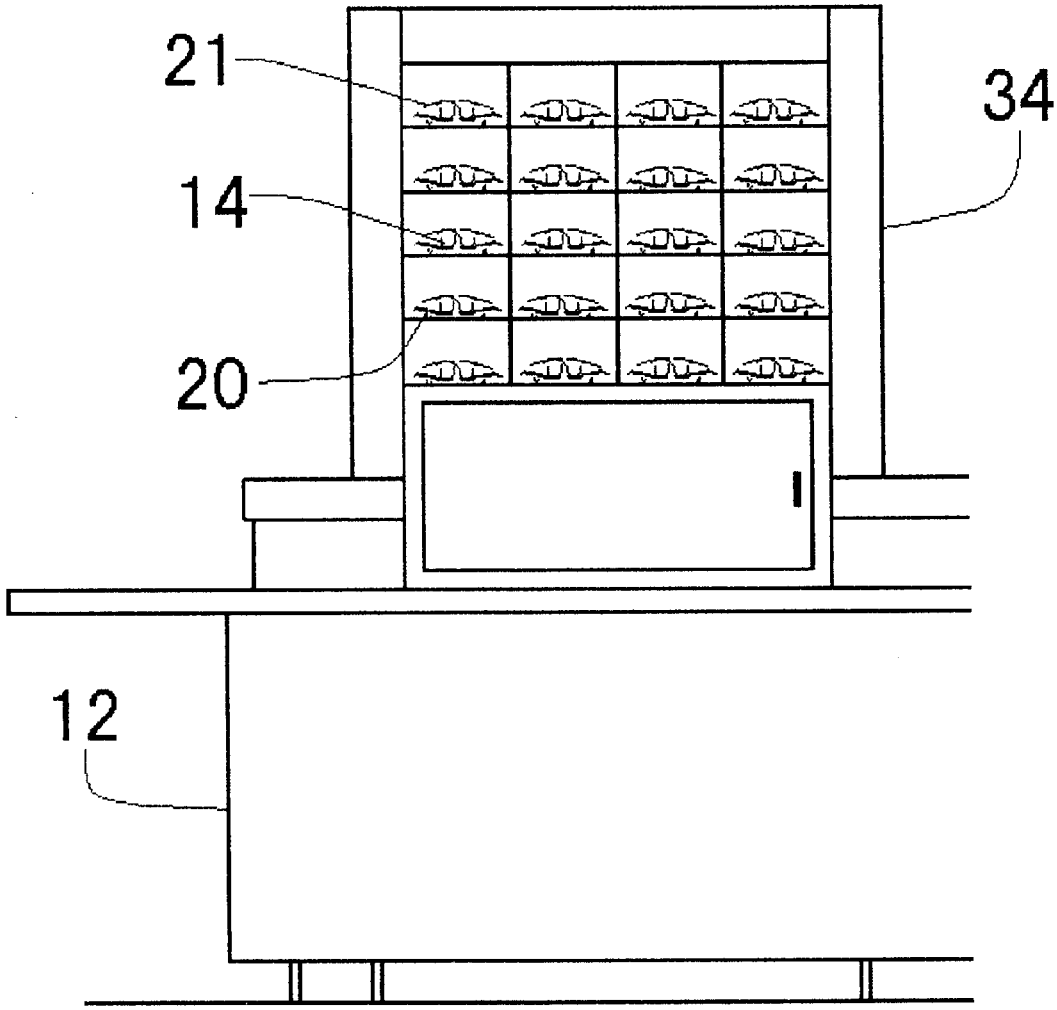
FIG. 3 is an enlarged side view of the same.
Figure 4:
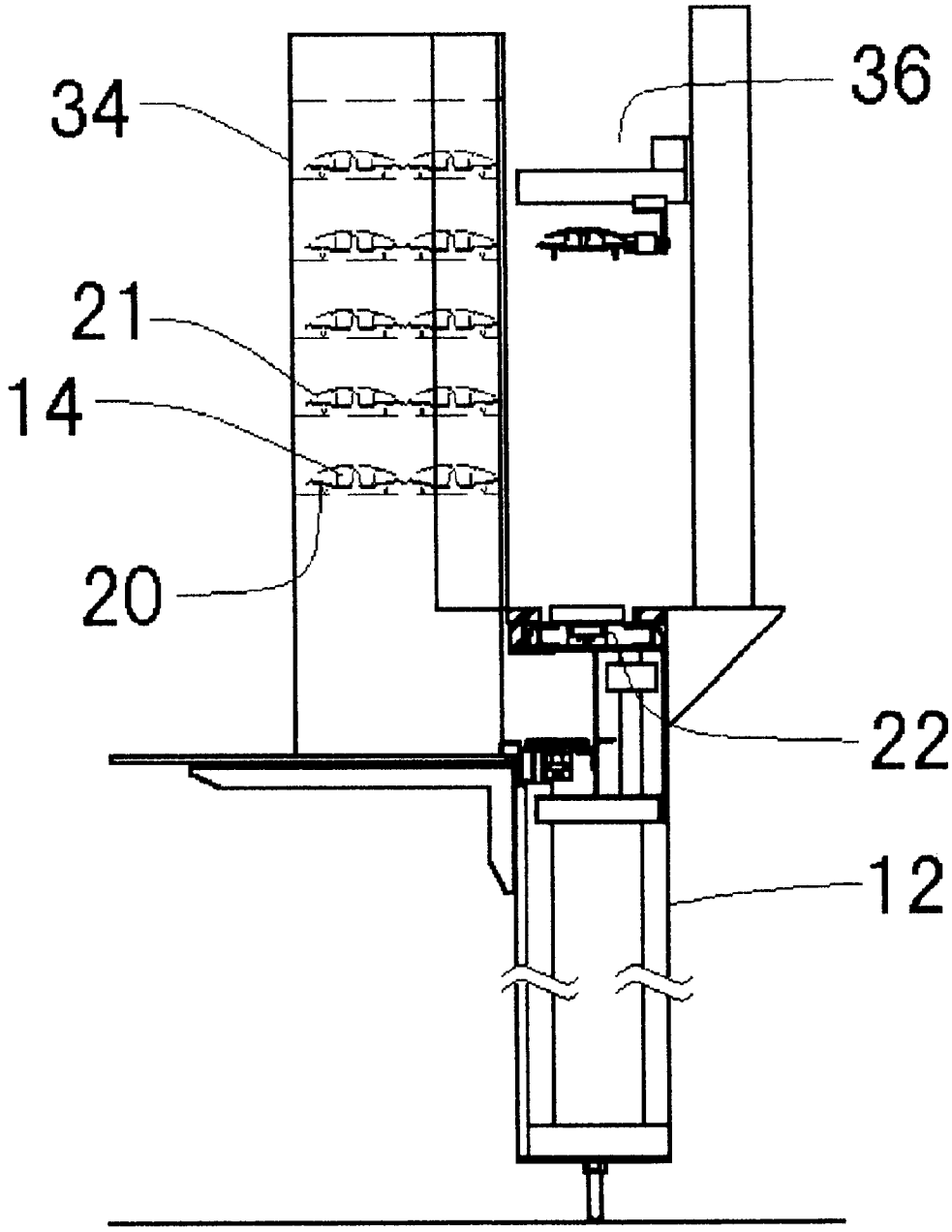
FIGS. 4 and 5 are enlarged front views showing the apparatus in operation.
Figure 5:
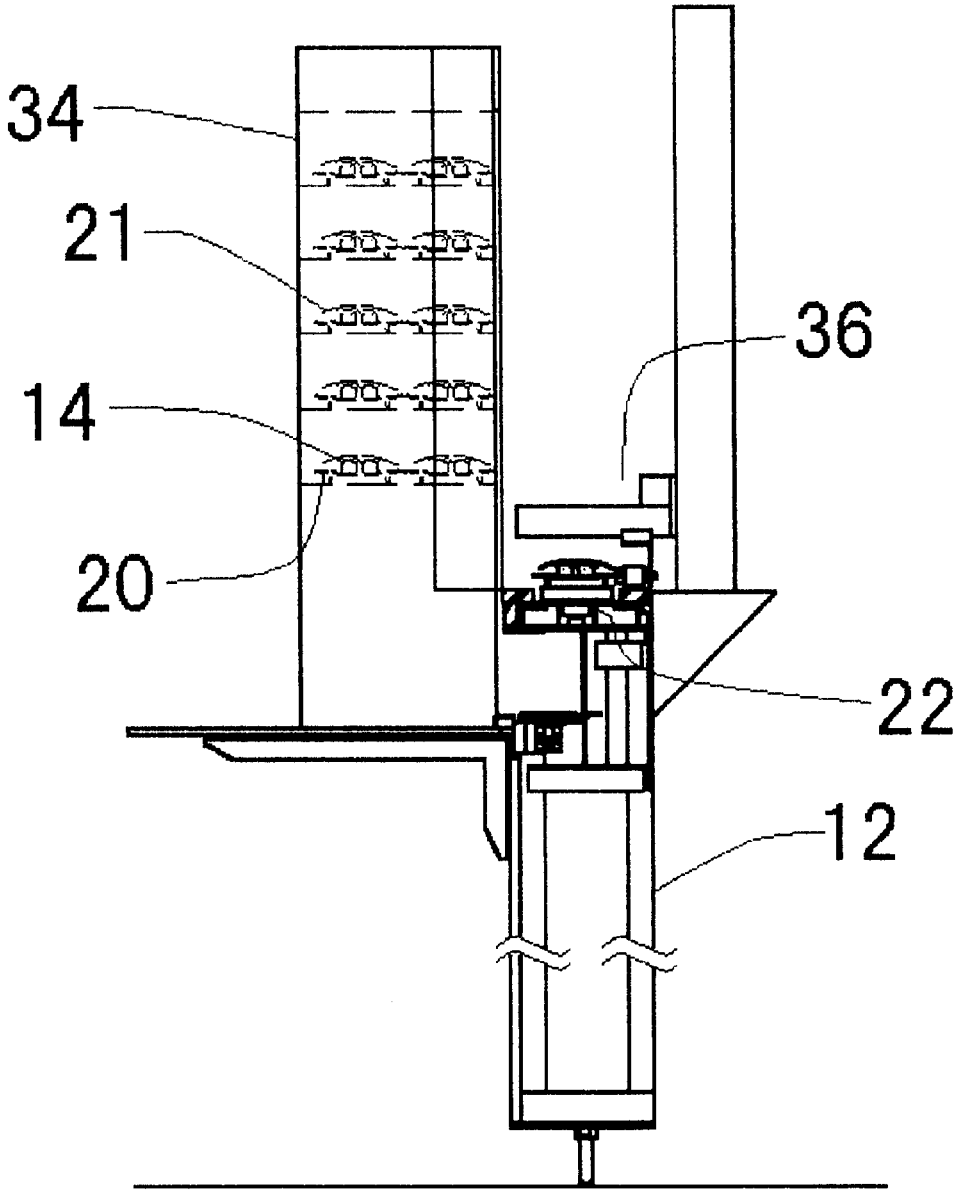

Also to be hygienic, a merchandise item 14 on the merchandise item tray 20 is desirably wrapped with a clean transparent film 21 as shown in FIGS. 3 to 5.

The rotary conveyer 22 as illustrated in FIGS. 1, 2, 7, 14 and 15 is conveniently made of a large number of conveyer elements 40, each of which is in the form of a crescent shaped conveyer plate and which are pivotally coupled together in series.

Figure 1:
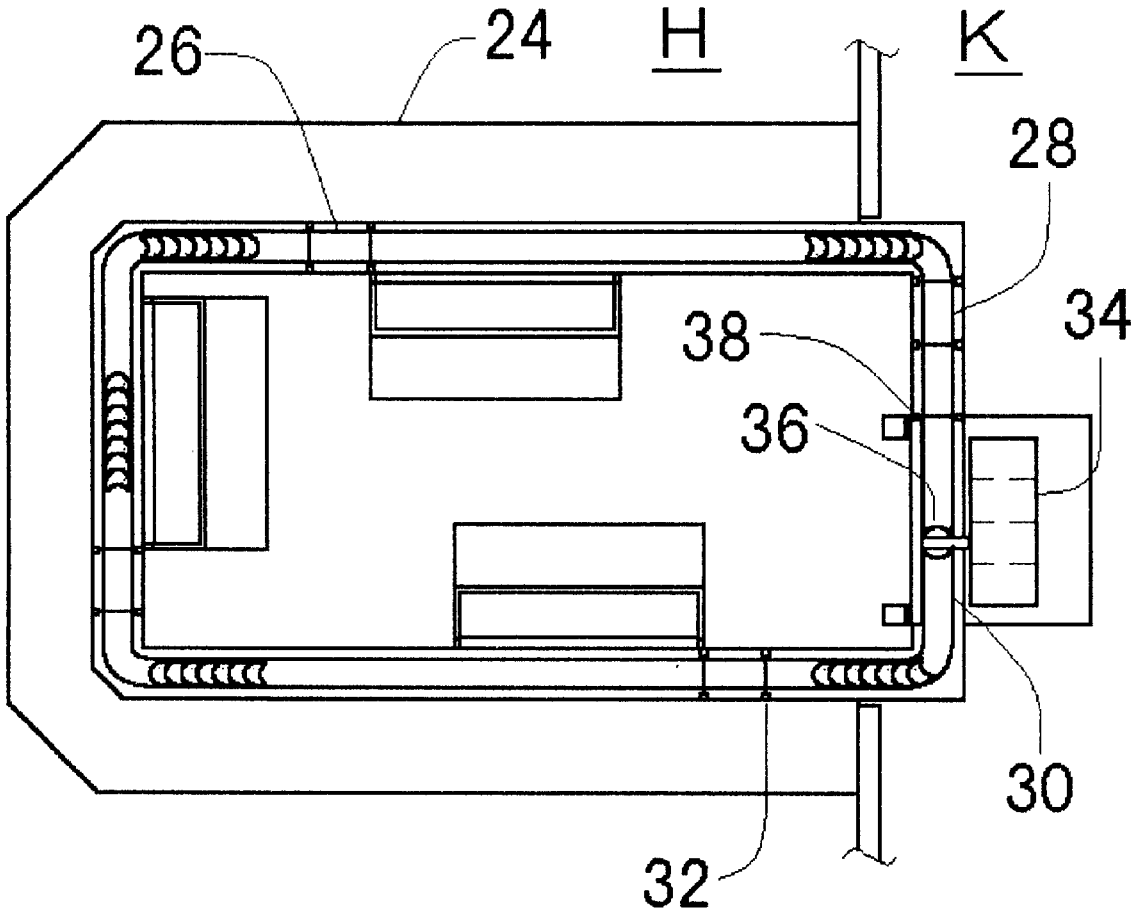
FIG. 1 is a top plan view diagrammatically illustrating a rotary catering table system incorporating an apparatus for serving a rotary conveyer with merchandise items according to the present invention.
Figure 6:
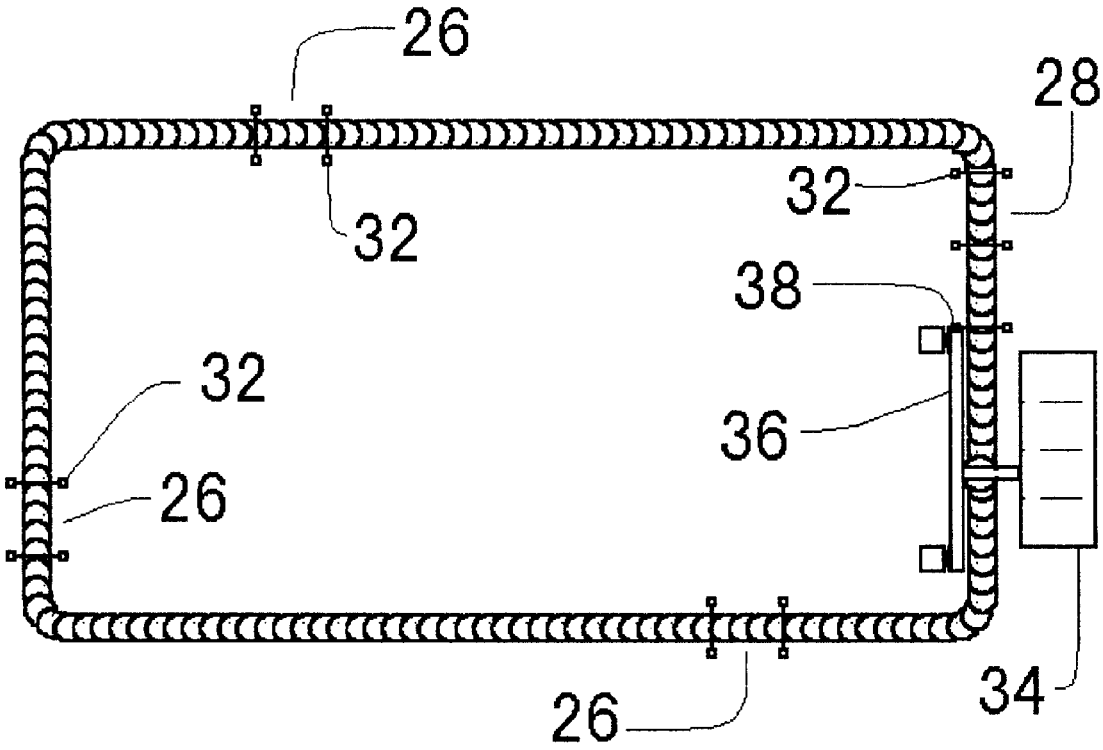
FIG. 6 is a top plan view illustrating a rotary conveyer lane provided with various zones according to the present invention.

For the purposes of one aspect of the present invention, the rotary conveyer 22 here is provided, as shown in FIGS. 1 and 6, with a merchandise item supply zone 26 to be served with a merchandise item 14 manually by an operator and a merchandise item recovery zone 28 at which to recover a merchandise item 14 that is deteriorating in freshness.

As illustrated, three such merchandise item supply zones 26 are arranged as spaced apart in the hall side H in the restaurant and one merchandise item recovery zone 28 is provided in the kitchen side K of the restaurant. An additional merchandise item supply or feed zone 30 for the rotary conveyer 22 is also provided, which is to be served with merchandise items 14 by a merchandise item feeder 36 as described below.

Measuring means 32 that determine the types of merchandise items being conveyed around on the rotary conveyer 22 and their respective numbers are provided in suitable number and spaced apart along the rotary conveyer 22.

In an illustrated form of embodiment, the measuring means 32 are specifically sensors each of which is designed to read an ID medium 62 fitted or attached to a freshness managing member 48 to be described later. These sensors 32 as shown in FIGS. 1 and 6 are positioned ahead of or adjacent to the merchandise item supply zone 26, the merchandise item recovery zone 28 and the merchandise item feed zone 30, respectively.

Disposed adjacent to the rotary conveyer 22 in the kitchen side K is a merchandise item stocker 34 that stores merchandise items 14 classified by type three-dimensionally therein, or in a plurality of compartments defined by tiers and rows therein. Adjacent to the merchandise item stocker 34, the merchandise item feeder 36 is also disposed adjacent to the rotary conveyer 22, here across its width, in the kitchen side K. The function of the feeder 36 is to take a particular merchandise item 14 designated out of the merchandise item stocker 34, and measure and transfer the same onto the rotary conveyer 22.

In the illustrated form of embodiment, the merchandise item stocker 34 is a three-dimensional structure to store merchandise items in a plurality of rows and a plurality of tiers therein. And the merchandise item feeder 36 is a lift that takes out and measures one by one the merchandise items 14, here merchandise item trays 20 loaded with sushi items in the illustrated form of embodiment, stored in the merchandise item stocker 34 and moves each item downwards as will be apparent from FIGS. 4 and 5.

With reference to FIGS. 3 to 5, making the merchandise item stocker 34 in the form of such a three-dimensional structure gives more than clear information as to the types and numbers of the merchandise items stored in the merchandise item stocker 34 and permits the presence or absence in any of the storage compartments or sections therein of a given merchandise item 14 to be checked in a moment.

The types of merchandise items 14 for storage in the merchandise item stocker 34 can be properly combined according to the time with respect to the business hours and the guests' favorite foods. And the number of storage compartments or sections may be greater for types of merchandise items to be consumed more abundantly and be smaller for those to be consumed less abundantly. Thus, efficiency of storage is achieved.

Means in the merchandise item feeder 36 for the merchandise items 14 though not shown in any of the Figures may be a counter or the like that only measures the numbers of the merchandise items 14 whose particular types have been identified when they on designation are individually taken out of the merchandise item stocker 34. Data for these measured numbers can be used in management together with data for those kinds the merchandise items designated by a processing means 70 to be described later.

To ease transferring a merchandise item 14 to the merchandise item feeder 36, it is desirable that the storage compartments or sections have their floors declining towards the merchandise item feeder 36.

It is also desirable that the merchandise item feeder 36 for the reason of transferring a merchandise item 14 onto the rotary conveyer 22 that is moving be configured as capable of feeding the merchandise items 14 onto the rotary conveyer 22 synchronously with the rate at which the rotary conveyer 22 is caused to move.

At the position where the merchandise item feeder 36 is installed, as shown in FIGS. 1 and 6 a detecting means 38 is disposed that detects a place on the rotary conveyer 22 that is vacant and devoid of a merchandise item 14.

The detecting means 38 in the illustrated form of embodiment is a detecting sensor.

Referring now to FIGS. 7 to 11, freshness managing members 48 are shown as each staying attached to and corresponding in shape to a conveyer element 40 of the rotary conveyer 22. Each of the freshness managing members 48 has a sense portion 42 disposed on a top surface thereof and a warning device 44 located in an interior thereof. The freshness managing member 48 is operable for actuation by supply of a merchandise item 14 as indicated by the sense portion 42, and for measuring time elapsing for the merchandise item 14 after supply, to cause the warning device 44 to issue a warning about a predetermined lapse of time after the supply. Each freshness managing member 48 also includes a lightness detecting means 46 that senses lightness in the restaurant. The function of the lightness detecting means 46 is to render the freshness managing members 48 operable only while it is sensing the lightness in the restaurant (during the business hours) and to suspend its freshness managing operation in the time zone outside the business hours in which it is dark in the restaurant and the lightness detecting means senses no light.

Figure 8:
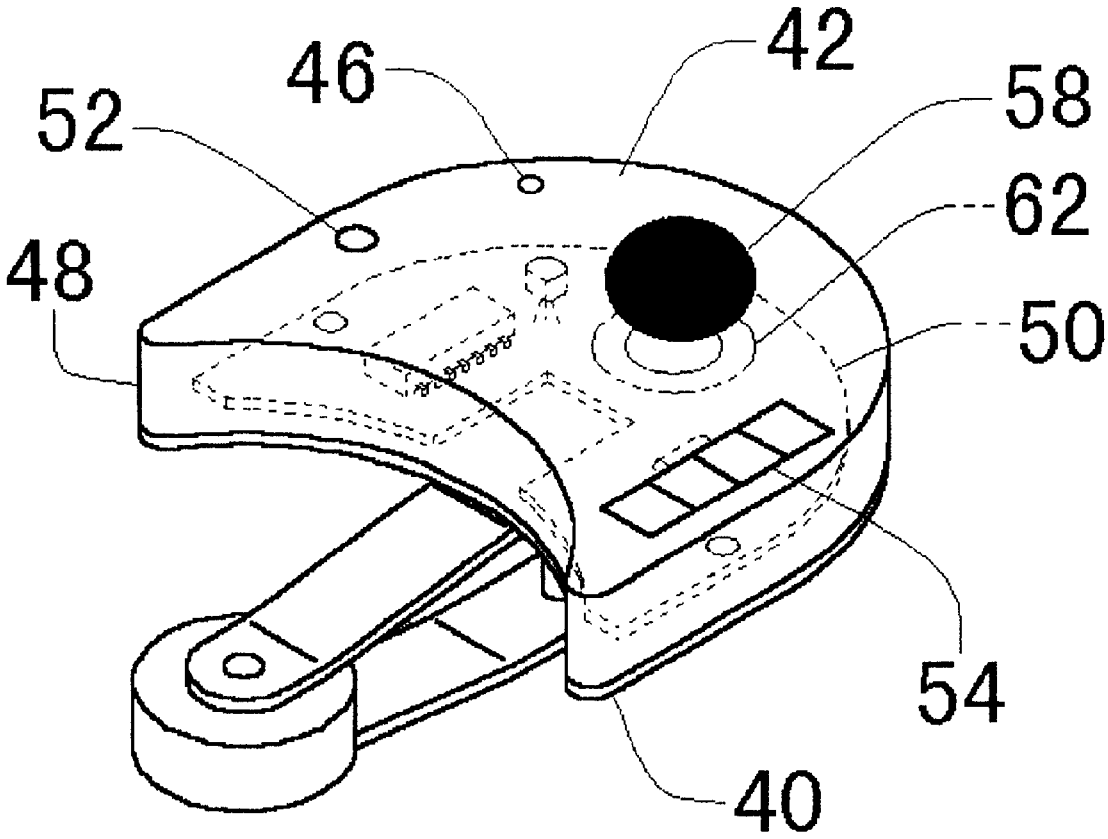
FIG. 8 is an enlarged perspective of the freshness managing member attached to a rotary conveyer element shown in FIG. 7.
Figure 9:
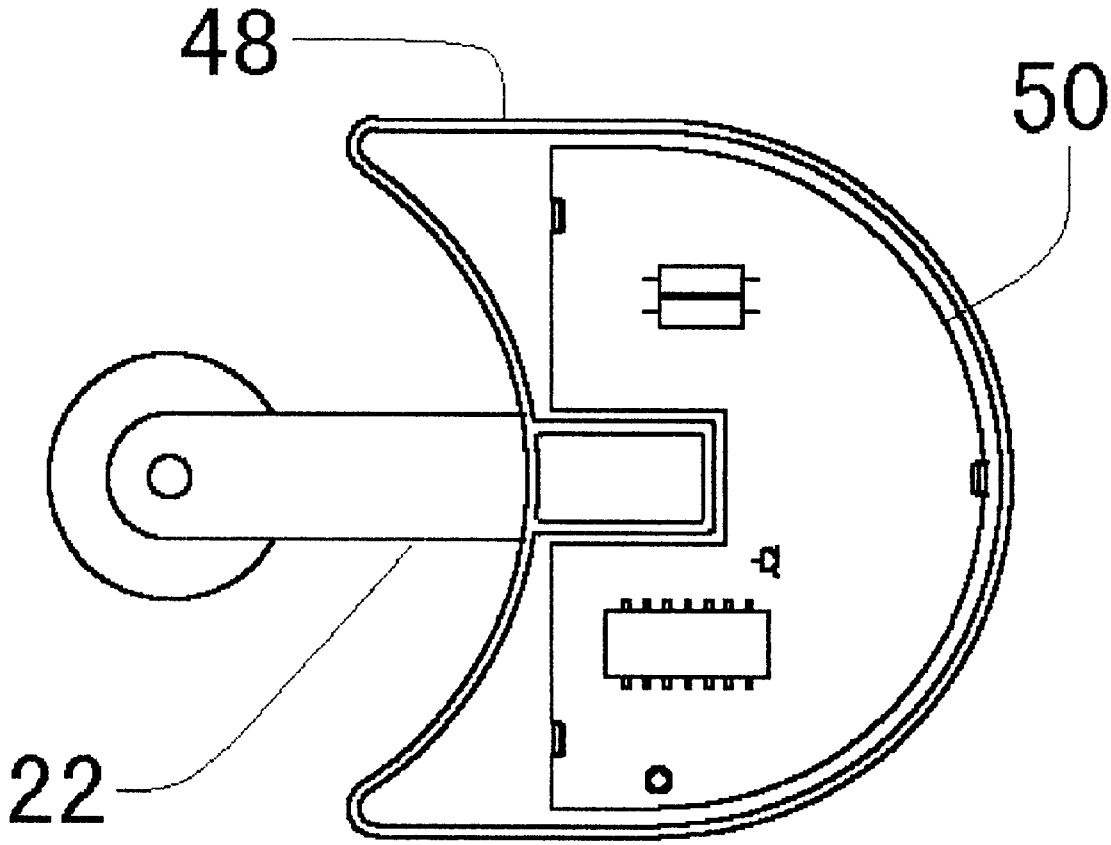
FIG. 9 is a bottom plan view of the freshness managing member shown in FIG. 8.
Figure 10:
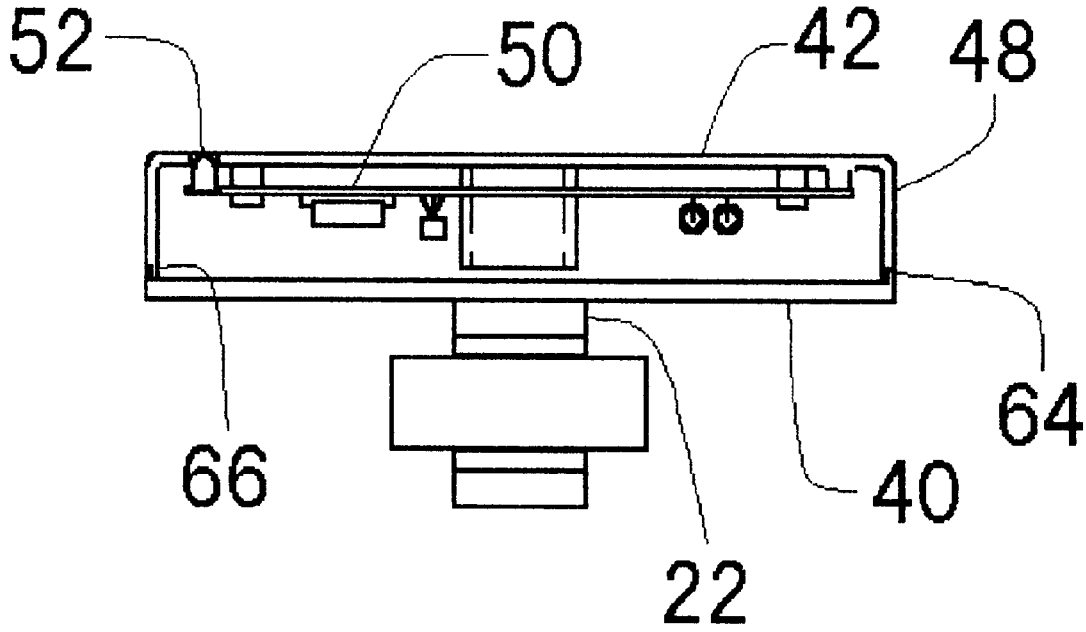
FIG. 10 is a side view of the freshness managing member shown in FIGS. 8 and 9.
Figure 11:
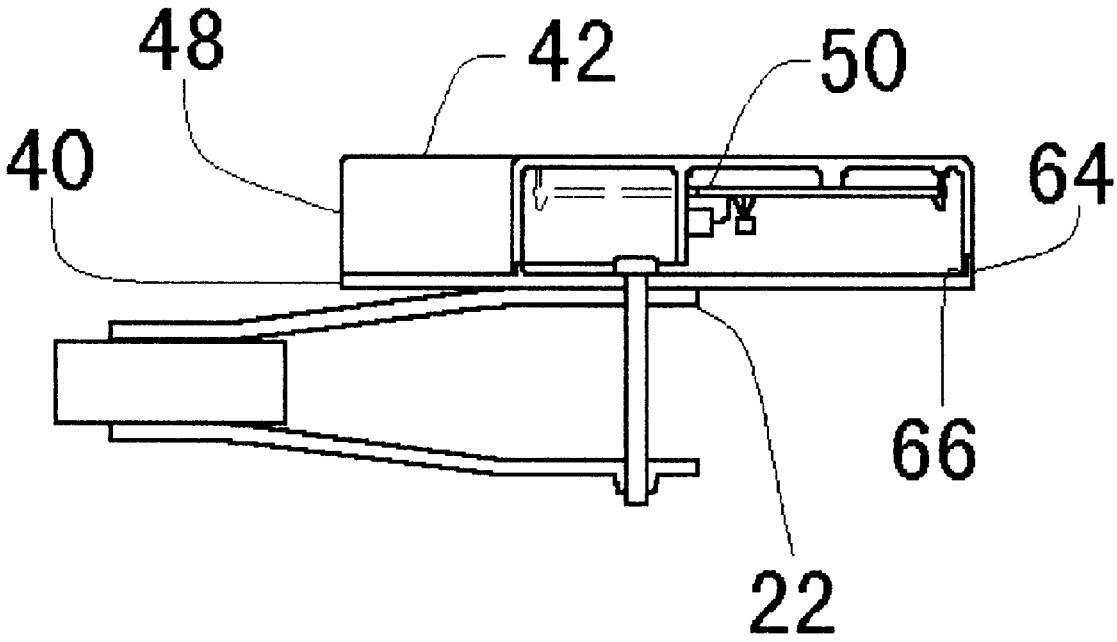
FIG. 11 is a front view of the freshness managing member shown in FIGS. 8 to 10.

In the illustrated form of embodiment, the sense portion 42 that senses supply, i.e., placement on the freshness managing member 48 of a merchandise item tray 20 loaded with its merchandise item 14 is a touch sensor as shown in FIGS. 8, 10 and 11.

Also, in the freshness managing member 48 as illustrated the lightness detecting means 46 is a lightness sensor as seen in FIG. 10, and the means for measuring lapse of time is constituted by a micro-computer unit 50 as seen FIG. 8.

Also, the warning means for the warning device 44 is here constituted by a light emitting diode 52, which is shown in FIGS. 8 and 10 as disposed in a top surface of the freshness managing member 48 so that light emission may be discerned from either the counter 24 side or the working space side S of the rotary catering table (see FIG. 15).

Figure 12:
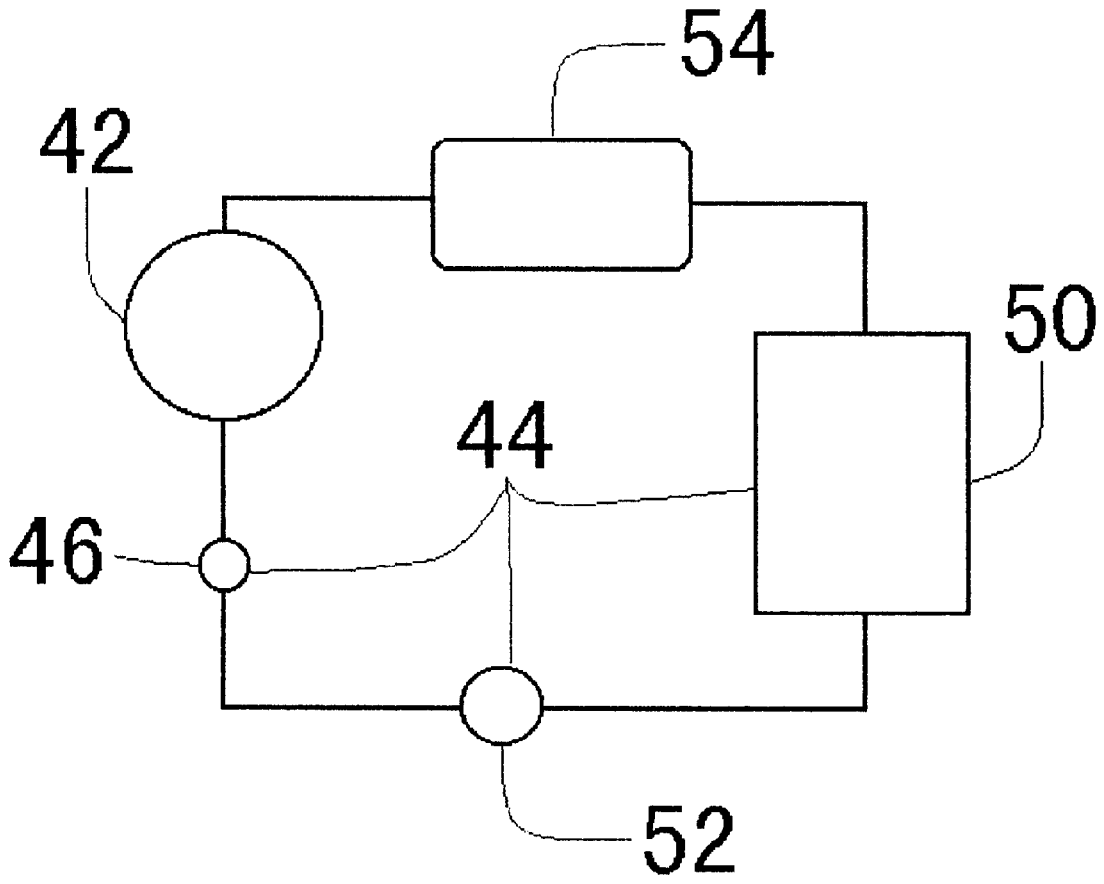
FIG. 12 is a simplified circuit diagram illustrating a makeup of a merchandise item freshness managing arrangement according to the present invention.

As shown in FIGS. 7 and 8, a solar battery 54 that acts as a power supply for the freshness managing mechanism is included in the top surface of the freshness managing member 48 to power the same. FIG. 12 shows an electrical connection of the solar battery 54 to the sense portion 42 and also to the warning device 44 formed of the lightness detecting means 46, the microcomputer unit 50 and the light emitting diode 52. It will be seen that turning off the lightness detecting means de-energizes all these electrical components.

Thus, by rendering the freshness managing mechanism formed of the sense portion 42, the microcomputer unit 50 and the light emitting diode 52 operable only while the lightness detecting sensor means 46 senses light and suspending operation of the freshness managing mechanism in the time zone (i.e. during the time period) outside of the business hours of the restaurant in which its inside is dark and the lightness detecting sensor means 46 does not sense lightness, consideration is here taken to save power consumption as needed for the freshness managing (warning by illumination) operation and to prolong the durable years of each of these devices.

Also as shown in FIGS. 7 and 8, an identifier 58 having a particular color or pattern 56 applied to its upper surface side is detachably fitted in a top surface area of the freshness managing member 48.

The manner in which the identifier 58 is fitted in the freshness managing member 48 is such that as shown in FIG. 7 the identifier 58 is fitted into an insertion slot 60 that is formed in the surface of the freshness managing member 48 so as to correspond in shape to the identifier 58.

This configuration permits the identifier 58 to be attached to and detached from the freshness managing member 48 very easily and allows such identifiers 58 to be varied readily as desired in type, number and pattern of arrangement.

Also, as shown in FIG. 8 the ID medium 62 capable of recording or registering the type of a merchandise item 14 is incorporated in the freshness managing member 48.

In this form of embodiment illustrated, the ID medium 62 may be what is called an "ID tag" that is known generally as a data carrier or information carrier, which are readable and/or writable without contact, and is designed to communicate by way of electric wave with the measuring means 32 and the detecting means 38 previously described in connection with FIGS. 1 and 6.

The ID medium 62 stores data for the type or price of a merchandise item 14 that corresponds to the color or pattern 56 of an identifier 58 attached to the freshness managing member 48, e.g., data for the type such as "tako" (octopus) or "ika" (cuttlefish) or the price of ¥100 that corresponds to the color or pattern 56 of red, data for the type such as "maguro" (tuna) or "hamachi" (young yellowtail) or the price of ¥200 that corresponds to the color or pattern 56 of blue, or data for the type such as "chu-toro" (medium oily tuna) or "tai" (sea bream) or the price of ¥300 that corresponds to the color or pattern 56 of yellow.

Also, the freshness managing member 48 is made to correspond in shape to the conveyer element 40 and is attached to the conveyer element 40, as will be seen from FIGS. 10 and 11 by engaging a raised periphery 64 formed on the conveyer element 40 and a stepped lower peripheral end 66 of the cup-shaped, freshness managing member 48 with each other.

Also, in this form of embodiment illustrated, it should be noted that the freshness managing members 48 are not attached to all of the conveyer elements 40 but are attached only to one of each pair of adjacent conveyer elements 40, the other of which has a simple cover member 68 attached thereto as shown in FIG. 7 in which is not incorporated any freshness managing mechanism as described. In other words, the freshness managing member 48 and the simple cover member 68 are alternately attached to a series of conveyer elements 40 of the rotary conveyer 22, thereby reducing the number of freshness managing members 48 used. It will be seen, therefore, that a large reduction in cost is here achieved compared with the arrangement in which an expensive ID medium that is increasingly used in recent years is each individually attached to a merchandise item tray, and thus in which a large number of ID media are required as large as about 1000 to 3000.

Here, a cover member 68 is attached to a conveyer element 40 just as is a freshness managing member 48 attached to a conveyer element 40, by engaging a raised periphery 64 formed on the conveyer element 40 and a stepped lower peripheral end 66 of the cup-shaped, cover member 68 with each other.

This arrangement permits the two conveyer elements 40 having the freshness managing member 48 and the cover member 40 respectively attached thereto to be each seen in appearance as a unitary plate, and thus will give guests no sense of incompatibility.

While commonly because of a limited size of a conveyer element 40, it may often be the case that a single merchandise item tray 20 is placed across two adjacent conveyer elements 40, it should also be noted that the arrangement mentioned above of disposing the freshness managing member 48 and the simple cover member 68 eliminates the need that when a merchandise item tray 20 loaded with a merchandise item 14 of the type that corresponds to the color or pattern 56 applied to the identifier 58 attached to a freshness managing member 48 is placed on that freshness managing member 48, the tray 20 be centered on the member 48. No matter where the merchandise item tray 20 may be placed on the freshness managing member 48 and a cover member 68 adjacent thereto, the sense portion 42 of the freshness managing member 48 will be able to sense the merchandise item tray 20 loaded with the merchandise item 14. The results are a sharp decrease in the work load imposed on supplying merchandise items and a rise in the ability to furnish with merchandise items.

The measuring means 32 and the detecting means 38 (FIGS. 1 and 6) mentioned before are connected to the processing means 70 as shown in FIG. 14. The processing means 70, which is conveniently a computer in the illustrated form of embodiment, is here designed to display and indicate the types and the numbers of merchandise items 14 found becoming short in supply from the readout by the measuring means 32, and to issue a warning for, and to alert to, the presence of a merchandise item 14 that has had a predetermined lapse of time after supply and thus is deteriorating in freshness.

Storing this processing means 70 in advance with all the data stored in the ID media 62 allows checking in real time the types, the numbers and the prices of merchandise items 14 being supplied on the freshness managing members 48 having the ID media 62 incorporated therein, respectively, and in turn permits the sales figure to be managed as well.

Also, since the presence of a merchandise item 14 that is deteriorating in freshness is alerted to and warned not only by the freshness managing member 48 but also by the processing means 70, even if the warning by the freshness managing member 48 is overseen by one operator, another operator will be able to confirm on the screen or the like of the processing means 70 the presence of the merchandise item deteriorating in freshness, thus enabling the same to be recovered or withdrawn outright. Freshness management for merchandise items 14 with greater certainty is thereby made possible.

With the freshness managing member 48, so constructed and arranged as mentioned above, set in an operable state only while the lightness detecting means 46 is sensing lightness (only during the time zone of the business hours of the restaurant in which lighting apparatus in it are actuated), supplying its top surface with a merchandise item tray 20 having a merchandise item 14 placed thereon will first cause the touch sensor as the sense portion 42 to sense the merchandise item tray 20 having the merchandise item 14 placed thereon. Then, the microcomputer unit 50 as the time measuring means is operated to start measuring time elapsing for the merchandise item 14 supplied. After a predetermined lapse of time, that is, if the sushi merchandise item 14, as it is conveyed by the crescent rotary conveyer 22, still remains uneaten by guests for the predetermined lapse of time and thus is deteriorating in freshness with its neta 18 drying and tending to be dehydrated and its shari 16 becoming cold, the presence of the merchandise item tray 20 loaded thereon with that merchandise item 14 is alerted to by the light emitting diode 52 as the warning means, which then illuminates (by lighting up or turning on and off or flickering).

To enable freshness of merchandise items 14 to be managed readily type by type, the timing of lighting or flickering of the light emitting diode 52 may be set to vary according to the type of merchandise items 14 so that it lights or flickers upon a lapse of time of, e.g., ten (10) minutes for the neta being sashimi, twenty (20) minutes for the neta being a "yakimono" (roasted or broiled item) such as "tamago" (egg), "ebi" (shrimp), "anago" (sea eel) or the like.

Figure 16:
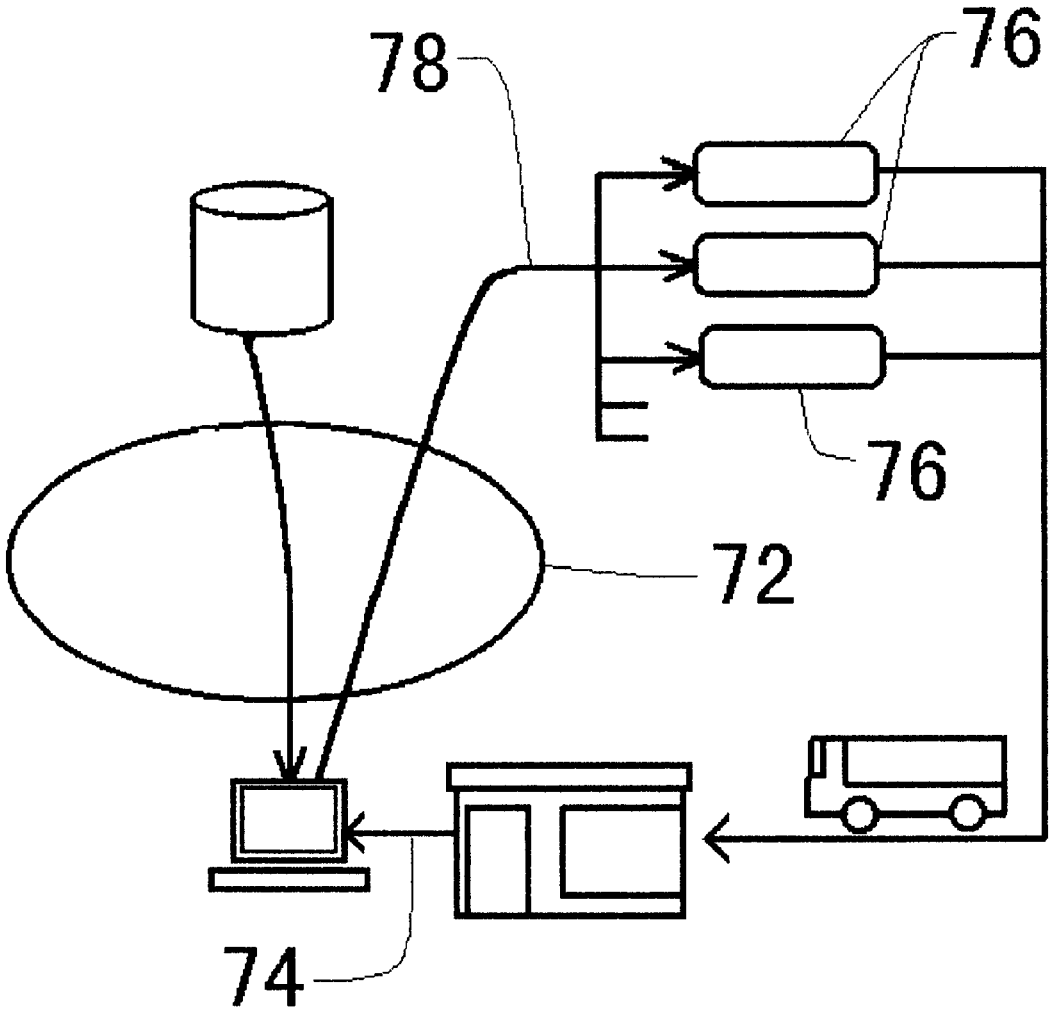
FIG. 16 is a diagrammatic illustration of a basic makeup of a merchandise item managing system according to the present invention.
Figure 17:
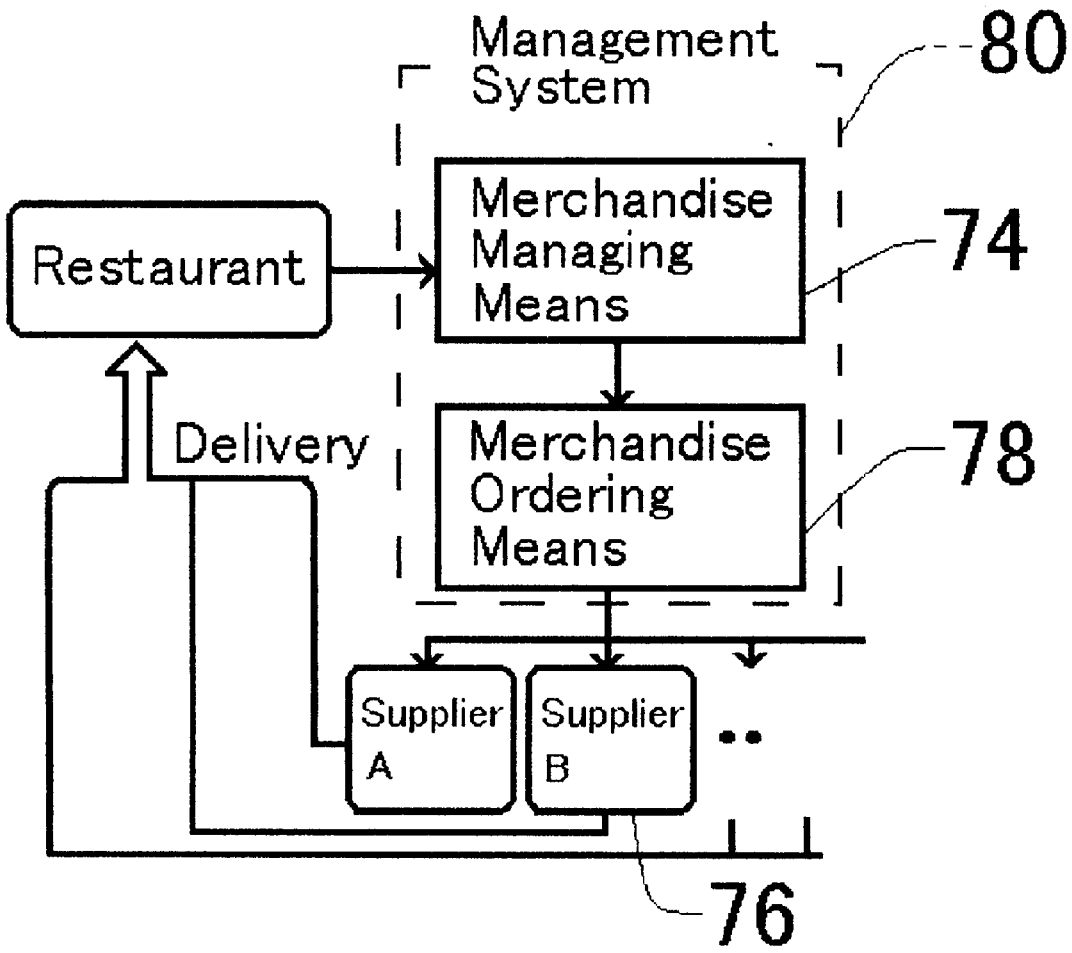
FIG. 17 is an entire block diagram of a merchandise item managing system of the present invention as shown in FIG. 16.

Also, as shown in FIGS. 16 and 17 it should be noted that the processing means 70 has a management system 80 installed therein that is operable for execution on or with an information communication network such as the internet. The management system 80 is shown as comprising a merchandise item and material managing means 74 that manages merchandise items 14 and their raw materials such as fresh fish materials and rice, and a merchandise item and/or material ordering means 78 that orders needed merchandise items and/or materials from member suppliers 76 item by item and/or material by material.

The merchandise item and material managing means 74 is operable in each restaurant or store to manage merchandise items 14 on entry of data including data that represent the types of the merchandise items supplied by the merchandise item feeder 36 and their respective numbers and the types of the merchandise items recovered at the merchandise item recovery zone 28 and their respective numbers, to determine the types of merchandise items 14 and their respective numbers or the types of materials such as neta and their respective amounts as well as expendable supplies such as soy sauce and throwaway trays as needed the next day.

The merchandise item and/or material ordering means 78 is then operable to order each of the needed types of commodities as merchandise items and/or materials and their respective amounts determined by the merchandise item and material managing means 74, automatically by means such as an E-mail or facsimile over an information communication network from a respective supplier 76.

In this case, it is also possible to change an order of merchandise items and/or materials as needed on the side of an individual restaurant or shop.

Accordingly, a highly beneficial arrangement is hereby set up wherein by automatically entering into the merchandise item and material managing means 74 on this management system 80 data for merchandise item supply by the merchandise item feeder 36 and so forth in each restaurant or store, it becomes possible to construct its own management data automatically by the managing means 74 and, also on the basis of the management data, to order automatically by the ordering means 78 necessary commodities as merchandise items and/or materials type by type from a respective supplier 76 by an E-mail or facsimile. As a result, the burdens so far imposed in buying merchandise items and materials are totally eliminated, any ordering error becomes nil, and the delivery of merchandise items and materials ordered from various suppliers is made certain.

Besides, the management system 80 described can be so designed as to identify, on the basis of the merchandise item management data, and indicate an ideal pattern of arrangement of merchandise items 14 being conveyed around on the rotary conveyer lane, for each day and for each time zone in the business hours.

Further shown in the drawing figures are an additional conveyer 82 (FIGS. 13 and 15) for conveying tea cups therein, and a faucet 84 (FIG. 13) for supplying hot water for tea.

A method is set forth below in detail by which the apparatus described serves, supplies and replenishes the rotary conveyer 22 with merchandise items 14.

Referring first to FIG. 7, the freshness managing members 48 and the cover member 68 are in advance alternately attached to the conveyer elements 40 of the rotary conveyer 22, with a freshness managing member 48 attached to one of two adjacent conveyer elements 40 and a cover member 68 on the other, successively.

This arrangement permits the two conveyer elements 40 having the freshness managing member 48 and the cover member 68 respectively attached thereto to be each seen in appearance as a unitary plate, and thus will give guests no sense of incompatibility.

By attaching the freshness managing member 48 and the cover member 68 alternately to a series of conveyer elements 40 of the rotary conveyer 22, not only is the number of freshness managing members 48 used reduced, but also a large reduction in cost is achieved compared with the arrangement in which an expensive ID media that are increasingly used in recent years are each individually attached to a merchandise item tray, and thus in which a large number of ID media are required as large as about 1000 to 3000.

Now, a merchandise item tray 20 loaded with a merchandise item 14 of a given kind is measured and supplied (placed) by the merchandise item feeder 36 (FIGS. 1 and 8) onto a freshness managing member 48 having an identifier 58 attached thereto with a color or pattern 56 that corresponds to that kind of merchandise items 14 and possibly placed also on a cover member 68 adjacent to the freshness managing member 48, and a number of such merchandise item trays 20 are each so measured and supplied (placed) successively and suitably located and distributed.

In this case, processing by the processing means 70 (FIG. 14) the data for the number of merchandise items 14 measured by the merchandise item feeder 36 for each type of merchandise items and the data for the types of merchandise items 14 supplied enables the types of merchandise items 14 supplied and their respective numbers to be managed altogether.

Also, a merchandise item tray 20 for supply is placed on a freshness managing member 48 having an identifier 58 attached thereto with a particular color or pattern 56 and is loaded with a merchandise item of a particular type or price identified by the particular color or pattern 56, e.g., a "tako" or "ika" item of the type at the price of ¥100 identified by the particular color or pattern 56 of red of the identifier 58, a "maguro" or "hamachi" item of the type at the price of ¥200 identified by the particular color or pattern of blue of the identifier 58, and a "chu-toro" or "tai" item of the type at the price of ¥300 identified by the particular color or pattern 56 of yellow of the identifier 58.

Also, pre-storing in the ID medium 62 incorporated in each freshness managing member 48 data for the type or the price of merchandise items 14 that corresponds to or is designated by the particular color or pattern 56 of the identifier 58 attached to that freshness managing member 48 and pre-registering all those data in the processing means 70 permit managing the types of merchandise items 14 turning round as placed over and carried by the rotary conveyer 22 and their respective numbers instantaneously, managing the sales of merchandise items 14 for each of the types instantaneously, and instantaneously displaying and indicating the type of merchandise items 14 that are becoming short of supply.

Also, to diversify types of merchandise items 14 supplied or offered in sequence and to change the pattern of arrangement in which they are offered in sequence depending on seasons, days of the week and/or time zones, e.g., in the daytime zone, to offer lower-priced merchandise items more abundantly and in the evening time zone, to offer merchandise items over the entire price range more abundantly in type, the identifiers 58 for fitting into the insertion slots 60 of the freshness managing members 48 may variably be arranged in sequence. Thus, several patterns of arrangement of identifiers 58 of identical and different colors or patterns 56 for interchangeable use as they fit may be established such as a sequential arrangement of identifiers 58 in which, for example, five (5) identifiers 58 colored red for their colors or patterns 56, five (5) identifiers 58 colored blue for their colors or patterns 56 and two (2) identifiers 58 colored yellow for their colors or patterns 56 are arranged repetitively.

It is also possible to change the pattern of arrangement of identifiers, hence types of merchandise items so as to be ideal for each particular day of week and for each particular time zone or business hour as determined by the management system 80.

Also, such a given sequential arrangement of identifiers 58 is here readily alterable in their individual types, numbers and pattern of arrangement by replacement; each identifier 58 for replacement may be removed from the insertion slot 60 of the freshness managing member 48 and is replaced with an identifier 58 having a particular color or pattern 56 applied thereto and specified by the type and/or pattern after alteration.

Referring next to FIG. 3, each section or compartment in the merchandise item stocker 34 is stored with a given plurality of merchandise item trays 20 each loaded with a merchandise item 14 of a given type.

In this case, efficiency of storage is achieved by making the combination of types of merchandise items 14 for storage in the business hours and the guests's favorite food, and changing the number of storage compartments or sections to be greater for types of merchandise items to be consumed more abundantly and to be smaller for those to be consumed less abundantly.

Also, making the merchandise item stocker 34 in the form of a three-dimensional structure as described before gives more than clear information as to the types and numbers of the merchandise items stored in the merchandise item stocker 34 and permits the presence or absence in any of the storage compartments or sections therein of a given merchandise item 14 to be checked in a moment. Therefore, to check the types of merchandise items that are becoming short and to check particular places to be supplied with merchandise items prepared, the need so far met to look over the entire area of the rotary conveyer or to watch a monitor are altogether eliminated. Thus, even an inexperienced operator such as a short term employment worker may sufficiently recognize types of merchandise items that are becoming short. The operator may simply be in front of the merchandise item stocker 34 to check the presence or absence in any of the storage compartments or sections therein of a given merchandise item 14, and may prepare one absent in a section and supply the section therewith. It thus becomes possible to offer merchandise items with an enhanced efficiency.

Next, as is seen from FIG. 14 the measuring means 32 identify the type of the merchandise items 14 on the rotary conveyer 22 and count their respective numbers, by reading the merchandise item data stored in the respective ID media 62 of the freshness managing members 48 loaded with those merchandise items, respectively, the data being transmitted to the processor means 70.

Next, the processing means 70 determines which specified types of merchandise items 14 on the rotary conveyer lane 22 are becoming short of supply in number each from a specified number, and indicates the determined types and respective numbers of merchandise items 14 to the merchandise item feeder 36 in the merchandise item feed zone 30 and the operator in the merchandise item supply zone 26.

Then, as seen from FIGS. 4 and 5 the merchandise item feeder 36 in the merchandise item feed zone 30 takes merchandise item trays 20 loaded with merchandise items 14 of the determined types and in the determined respective numbers out of the storage in the merchandise item stocker 34, and transfers these merchandise items 14 one by one onto the rotary conveyer 22 while counting their number for each type of the merchandise items 14.

In this case, upon the detecting means 38 detecting a place on the rotary conveyer 22 that is vacant and devoid of a merchandise item, the merchandise, when a freshness managing member 48 having an identifier 58 attached thereto with a particular color or pattern that corresponds to a particular type of merchandise items is detected to be arriving, the merchandise item feeder 36 in the merchandise item feed zone 30 is operated to take a merchandise item tray 20 that is loaded with a merchandise item 14 of that particular type and to place that merchandise item tray 20 anywhere on that freshness managing member 48 and a cover plate 68 adjacent thereto on the rotary conveyer 22.

Also, in the merchandise item manual supply zone 26, the operator prepares a merchandise item of the type indicated by the processing means 70. The merchandise item is loaded on a corresponding merchandise item tray that is then placed anywhere on a freshness managing member 48 having an identifier 58 attached thereto with the particular color or pattern 56 that corresponds to that particular type of merchandise items and on a cover plate 68 adjacent thereto on the rotary conveyer 22.

In this case as well, the measuring means 32 disposed in the merchandise item supply zone 26 reads the types of merchandise item and counts their respective numbers from the merchandise item data stored in the ID media attached to the freshness managing members 48, respectively. The data are transmitted to the processing means 70.

In this merchandise serving zone 26, however, the operator is a skilled sushi cook with sophisticated preparation technique whose performance is demonstrated to guests. Shown the performance the guests by realizing that they are offered merchandise items prepared by such skill can enjoy dining with this zone 26, which zone is thus envisaged to contribute to a rise in the sales of the restaurant.

It should also be noted that if a merchandise item tray 20 loaded with a merchandise item 14 is not placed on a freshness managing member 48 or cover member 68 but is served directly to a guest, thus on the counter 24 in his or her front by the operator (see also FIG. 15), entering the data for this service into the processing means 70 permits such services to be managed as well. Therefore, centralized management of all the merchandise items in the restaurant is still ensured.

Referring again to FIGS. 7, 8 and 12, it has been noted that the freshness managing member 48 is set in an operable state only while the lightness detecting sensor means 46 is turned on by sensing lightness, thus only during the time zone of business hours in which lighting apparatus are actuated. While the freshness managing member 48 is in its operative state, supplying its top surface with a merchandise item tray 20 loaded with a merchandise item 14 by placing the merchandise item tray 20 anywhere on the freshness managing member 48 and an adjacent cover member 60 will first cause the touch sensor as the sense portion 48 to sense the merchandise item tray 20 having the merchandise item 14 placed thereon. Then, the microcomputer unit 50 will be operated to start measuring time elapsing for the merchandise item 14 supplied. After a predetermined lapse of time following the supply, that is, if the sushi merchandise item 14 as it is conveyed by the rotary conveyer 22 still remains uneaten by guests for the predetermined lapse of time and thus is deteriorating in freshness with its neta 18 drying and tending to be dehydrated and its shari 16 becoming cold, the presence of the merchandise item tray 20 loaded thereon with that merchandise item 14 is alerted to by the light emitting diode 52 as the warning means, which then illuminates by lighting up or turning on and off or flickering.

Alerted by the light emitting diodes 52 illuminating, the operator in the recovery zone 28 (FIG. 1) will be able to recover, withdraw or get back such merchandise item trays 22 having merchandise items 14 placed thereon that are deteriorating in freshness.

In this case, it will become possible to manage freshness of merchandise items 14 easily type by type, by setting the timing of lighting or flickering of the light emitting diode 52 to vary according to the type of merchandise items 14 so that it lights or flickers upon lapse of time of, e.g., 10 minutes for the neta being sashimi, 20 minutes for the neta being a "yakimono" (roasted or broiled item) such as "tamago" (egg), "ebi" (shrimp), "anago" (sea eel) or the like.

Also in this case, having the predetermined lapse of time that the microcomputer unit 50 of the freshness managing member 48 measures vary suitably as a function of the season makes it possible to manage freshness of merchandise items with sureness according to the season.

Also, the microcomputer unit 50 is here designed to be automatically reset in each freshness managing member 48 when the merchandise item tray 20 thereon is taken by a guest so as to be ready to start timing for a replacement merchandise item tray 20 next supplied (placed) thereon.

Recovery of the merchandise item 14 in the recovery zone 28 is measured by the measuring means 32, which transmits data for the recovered merchandise item to the processing means 70.

Since the presence of a merchandise item 14 that is deteriorating in freshness is alerted to and warned not only by the freshness managing member 48 but also by the processing means 70 that monitors at all times the data transmitted from the measuring means 32 and the detecting means 38, even if the warning by the freshness managing member is overseen by one operator, another operator will be able to confirm on the screen of the processing means the presence of the merchandise item deteriorating in freshness, thus enabling the same to be recovered or withdrawn outright. Freshness management for merchandise items 14 with greater certainty is thereby made possible.

In this case, pre-registering data for all of the ID media 62 incorporated in the freshness managing members 48 allows the processing means 70 to collect and add by group the merchandise item data, i.e., the data for the types of the merchandise items 14 taken by guests and their respective numbers and the data for the types of the merchandise items 14 recovered on deteriorating in freshness and their respective numbers to display the types of merchandise items 14 that are becoming short in supply and their respective numbers on its screen or also a monitor (illustration omitted) installed in the working space S (FIG. 15) and to indicate them to operators, and also to furnish the merchandise item feeder 36 with the data for those merchandise items. Thus, not only are those types and their respective numbers supplied and served efficiently, but also it becomes possible to check in real time the types, numbers and prices of the merchandise items 14 that are turning around on the rotary conveyer 22.

According to this aspect of the present invention, it therefore becomes also possible to manage freshness of a merchandise item 14 placed on a merchandise item tray 20 each individually over an entire area of the looped rotary conveyer 22 and to allow only such merchandise item trays 20 as alerted to and warned to be selectively recovered or drawn back, thereby improving the recovering workability of merchandise items 14.

In addition, it becomes possible to supply the rotary conveyer lane 22 on which merchandise item trays 20 are missing with merchandise item trays 20 loaded thereon with the type of merchandise items 14 which are becoming short, thus permitting an abundance in type of merchandise items 14 to be offered efficiently on the rotary conveyer 22. It thus become possible that a guest can at any time choose to take any one of its favor from merchandise items 14 which are abundant and diversified in type, and can thereby enjoy dining. A rise in guest turnover and sales figures can in turn come about.

Since the merchandise item stocker 34 provides clear information of the types and their respective numbers of the merchandise items 14 stored and missing, an operator in checking those types and numbers is not required at all to carefully look over the entire area of the rotary conveyer to find vacant places thereon from which merchandise items are missing or to find a proper vacant place to be supplied with a merchandise item that he or she has just prepared. Since the presence or absence of a merchandise item in any given compartment or section in the merchandise item stocker 34 can be checked in a moment, it suffices for him or her to place a merchandise item 14 of type the particular compartment or section itself identifies on a corresponding merchandise item tray 20 and then simply to place that merchandise item loaded tray 20 in that compartment or section in the merchandise item stocker 34. There thus results an extreme rise in the efficiency in offering merchandise items.

Further, for an operator in the merchandise item serving zone, it suffices to simply prepare a merchandise item 14 of the type indicated by the processing means 70 as indicated by the computer 58 and to place such a merchandise item loaded tray 20 suitably on a freshness managing member 48 having an identifier 58 attached thereto with a particular color or pattern 56 corresponding to that particular type of merchandise items. Therefore, the need so far met for an operator to grasp the types of merchandise items which are becoming short by looking over the entire area of the crescent chain conveyer 18 is here again eliminated, and the load so far imposed on the operator in replenishing merchandise items is sharply reduced.

It is also possible to arrange a recovery conveyer (illustration omitted) along a portion of the rotary conveyer 22 and to dispose a movable guide member (illustration omitted) at a junction where the recovery conveyer and the rotary conveyer 22 are connected together. Then, the guide member is made operable in response to a warning by the freshness managing member 48 or the processor means 70 indicating a deterioration in freshness of a merchandise item to act on the rotary conveyer 22 so as to take the warned-of merchandise item tray 20 on which the merchandise item deteriorating in freshness is placed and to transfer the same along the guide member onto the recovery conveyer for recovery, thereby making it possible to mechanically recover merchandise item trays 20 having merchandise items 14 placed thereon that are deteriorating in freshness.

Also, in case freshness management of merchandise items 14 are not required, the freshness managing members 48 may remain intact while suspending the operation of each of its components incorporated, viz., the sense portion 42, the lightness detecting means 46 as the warning device 44, the microcomputer unit 50 and the light emitting diode 52.

The data for the merchandise items manually supplied in the merchandise item supply zone 26 and the data for the merchandise items served automatically by the merchandise item feeder 36 in the merchandise item feed zone 28 (FIG. 1) can be automatically entered into the merchandise item managing means 74 in the management system 80 shown in and described in connection with FIGS. 16 and 17. This permits the merchandise item managing means 74 to build up merchandise item managing data to allow the merchandise item ordering means 78 on the basis of the merchandise item managing data to automatically order needed commodities as merchandise item materials from suppliers 76 type by type each by means of an E-mail, facsimile or the like on an information communication network 72. As a result, the burdens so far imposed in buying merchandise items and materials are totally eliminated.

On the side of each supplier, the commodities ordered by the merchandise item ordering means 78 in each restaurant are arranged for and are delivered to the restaurant. Any ordering error being so far the case by telephone or the like is altogether eliminated, therefore, and the delivery of merchandise items and materials ordered from various suppliers is thus made certain.

Figure 18:
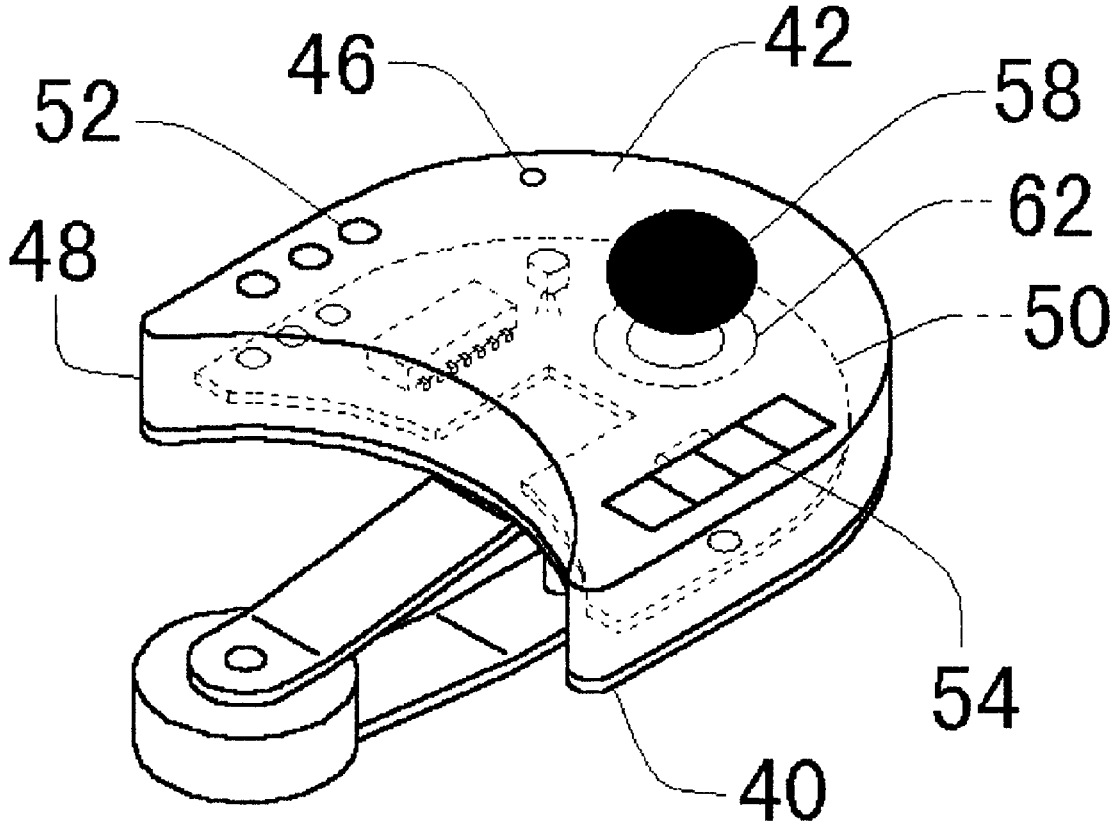
FIG. 18 is a perspective view illustrating another form of embodiment of the freshness managing member according to the present invention.
Figure 19:
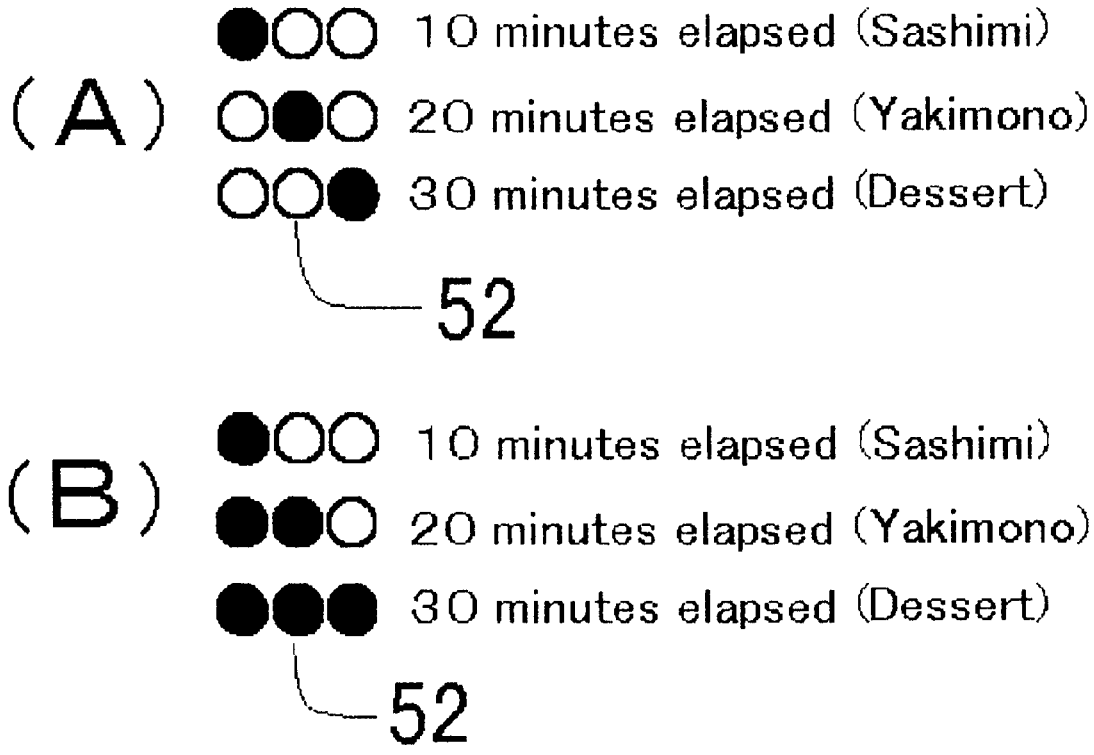
FIG. 19A and 19B are each an enlarged view illustrating how light emitting diodes may be turned on and off as the time elapses.

FIGS. 18 and 19 show an alternative form of embodiment of the freshness managing member 48.

As illustrated, the freshness managing member 48 in this form of embodiment makes use of a set of three (3) light emitting diodes 52, which are arranged in series. Then, to facilitate grasping elapsed times for merchandise items 14 of different types from their supply, the ordinal number (or location) of a particular light emitting diode 52 which is, or the total number of particular light emitting diodes 52 which are, caused to emit light (light up) may be varied as a function of elapsed time. Thus, a particular lapse of time that is given for a particular type of merchandise items 14 may be indicated by which one of the three light emitting diodes 52 is caused to emit light. For example, the lapse of ten (10) minutes given for a merchandise item 14 with its neta 18 being "sashimi" such as "ika" or "maguro" the lapse of twenty (20) minutes given for a merchandise item 14 with its neta 18 being "yakimono" such as "tamago", "ebi" or "anago", and the lapse of thirty (30) minutes given for a merchandise item 14 being a dessert item, are indicated either by the first, the second and the third from left light emitting diode 52 lighting up, respectively (see FIG. 19A), or by the first from left light emitting diode 52 alone, the first and second from left light emitting diodes 52 both, and the first to third from left light emitting diodes 52 all, lighting up, respectively (see FIG. 19B)).

The freshness managing member 48 in this form of embodiment may be used in the same manner as in the previous form of embodiment shown in and described in connection with FIGS. 7 to 13. A repeated description is therefore omitted.

Figure 20:
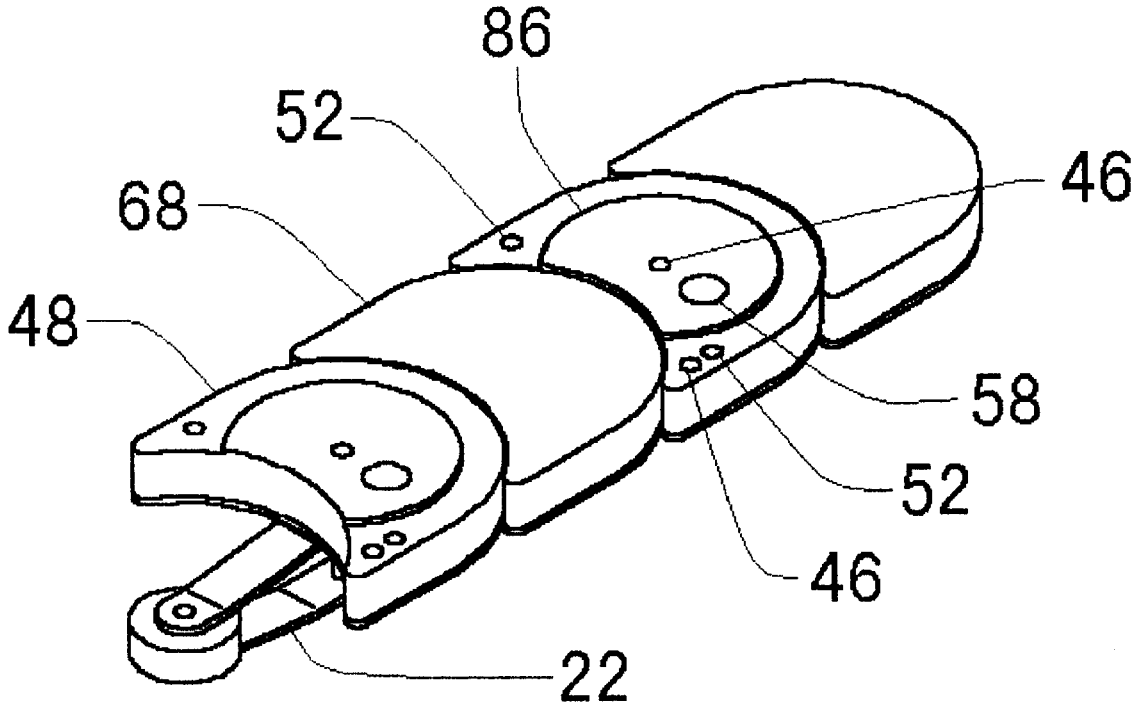
FIG. 20 is a perspective view illustrating a further form of the freshness managing member according to the present invention.

FIG. 20 shows a further alternative form of embodiment of the freshness managing member 48.

As illustrated, the freshness managing member 48 in this form of embodiment is structurally the same as the freshness managing member 48 shown in FIGS. 7 to 13 except that its top surface has a platform 86 on which a merchandise item tray 20 is designed to rest, a pair of light emitting diodes 52 are provided and located towards its rims, a pair of optical sensors 46 are respectively located at a center of the platform 86 for optically sensing a merchandise item tray 20 being placed thereon and, as the lightness detecting means, towards one of the rims and used to sense environmental lightness (in the eating establishment).

The freshness managing member 48 in this form of embodiment may be used in the same manner as that shown in and described in connection with FIGS. 7 to 13.

Figure 21:
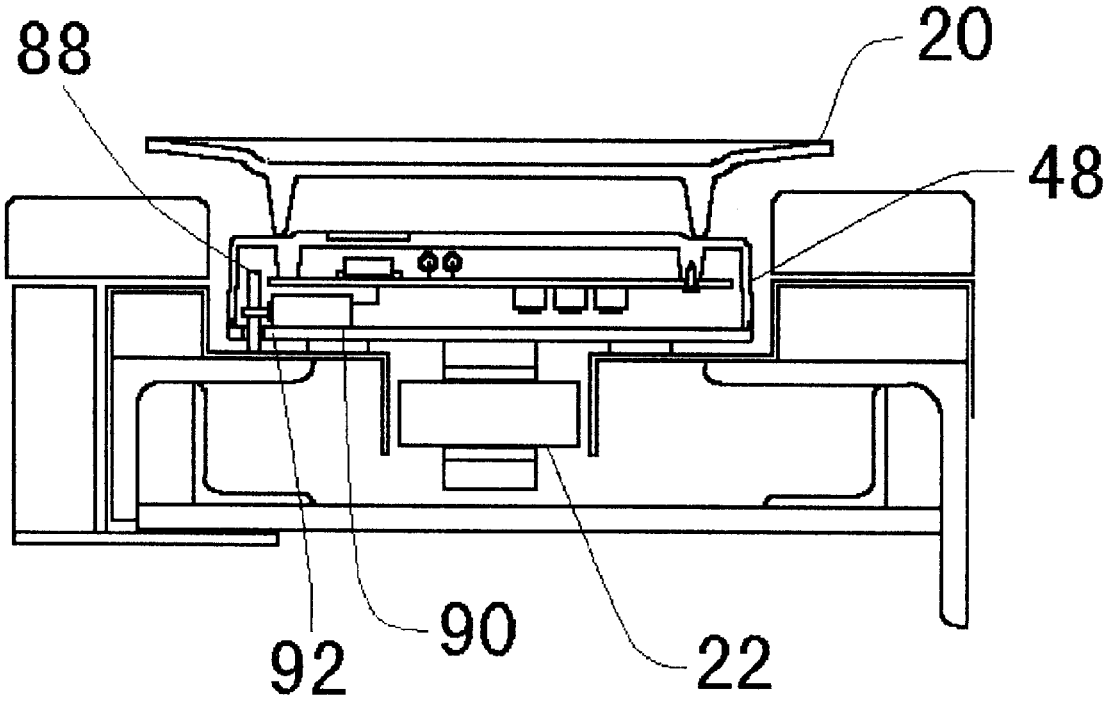
FIG. 21 is an enlarged cross sectional view illustrating an alternative form of embodiment of the freshness managing member according to the present invention.

FIG. 21 shows a further alternative form of embodiment of the freshness managing member 48.

As illustrated, the freshness managing member 48 in this form of embodiment incorporates therein a power generating mechanism 92, which is made of a power generating tire (wheel) 88 in combination with a capacitor 90, to substitute for the solar battery 54 in the freshness managing member 48 shown in and described in connection with FIGS. 7 to 13. Thus, the freshness managing member 48 in this form of embodiment is designed to self-generate electric power selectively while the rotary conveyer 22 is in service, thereby energizing its component devices and apparatus. In this case, it becomes possible to omit the lightness detecting means 46.

The freshness managing member 48 in this form of embodiment may be used in the same manner as that shown in and described in connection with FIGS. 7 to 13.

Figure 22:
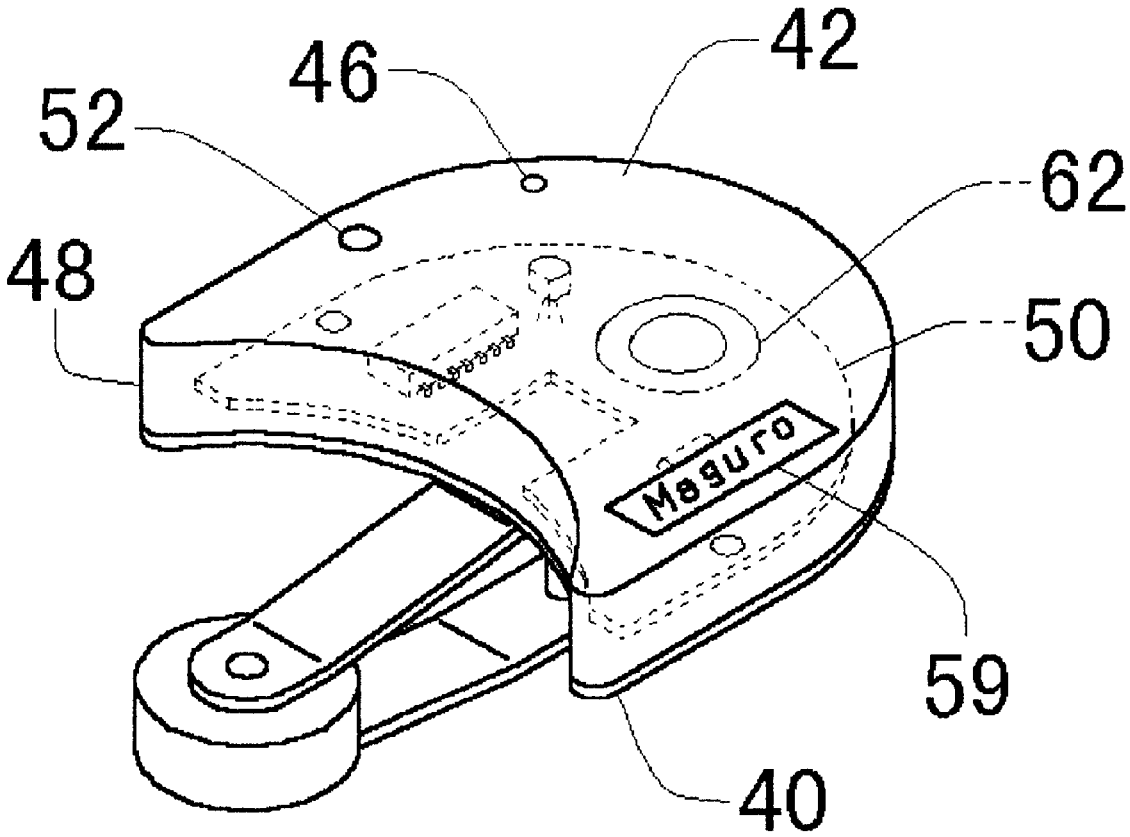
FIG. 22 is a perspective view illustrating a further alternative form of the freshness managing member according to the present invention.

FIG. 22 shows a further alternative form of embodiment of the freshness managing member 48.

As illustrated, the freshness managing member 48 in this form of embodiment incorporates a display plate 59 attached thereto, which displays by characters a type of merchandise item 14 to be loaded such as maguro or tako, to substitute for the identifier 58 shown in and described in connection with FIGS. 7 to 13. Thus, the freshness managing member 48 in this form of embodiment eliminates the need to make manual replacement of the identifiers 58 by entry into the processing means 70 to change the display in the display plate 59 when a change is made in the pattern of arrangement of merchandise items 14 being conveyed around.

The freshness managing member 48 in this form of embodiment may be used in the same manner as that shown in and described in connection with FIGS. 7 to 13.

Figure 23:
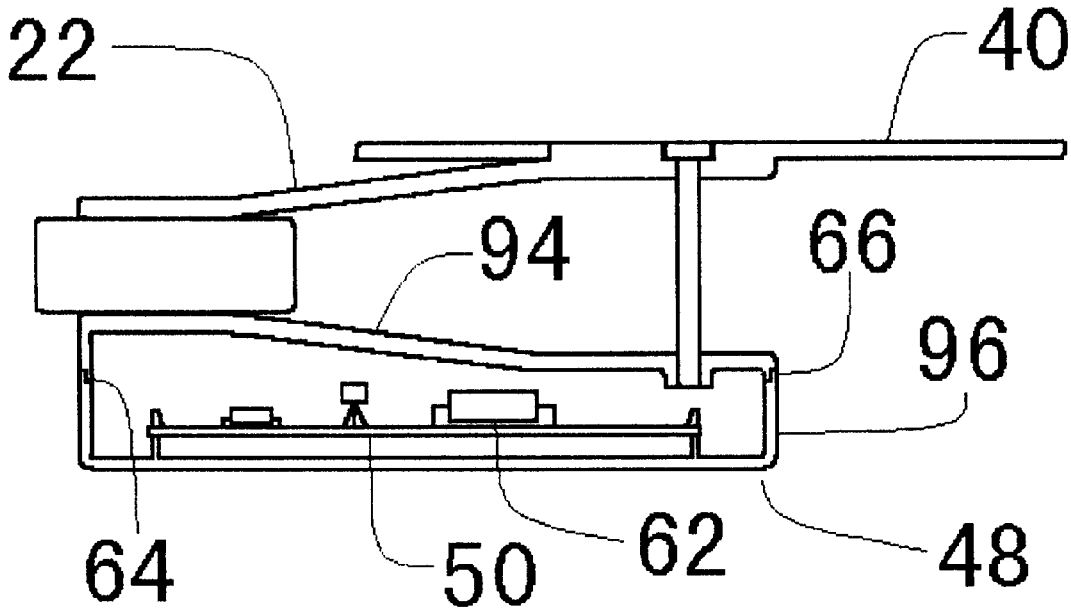
FIG. 23 is a cross sectional view illustrating a further alternative form of the freshness managing member according to the present invention.
Figure 24:
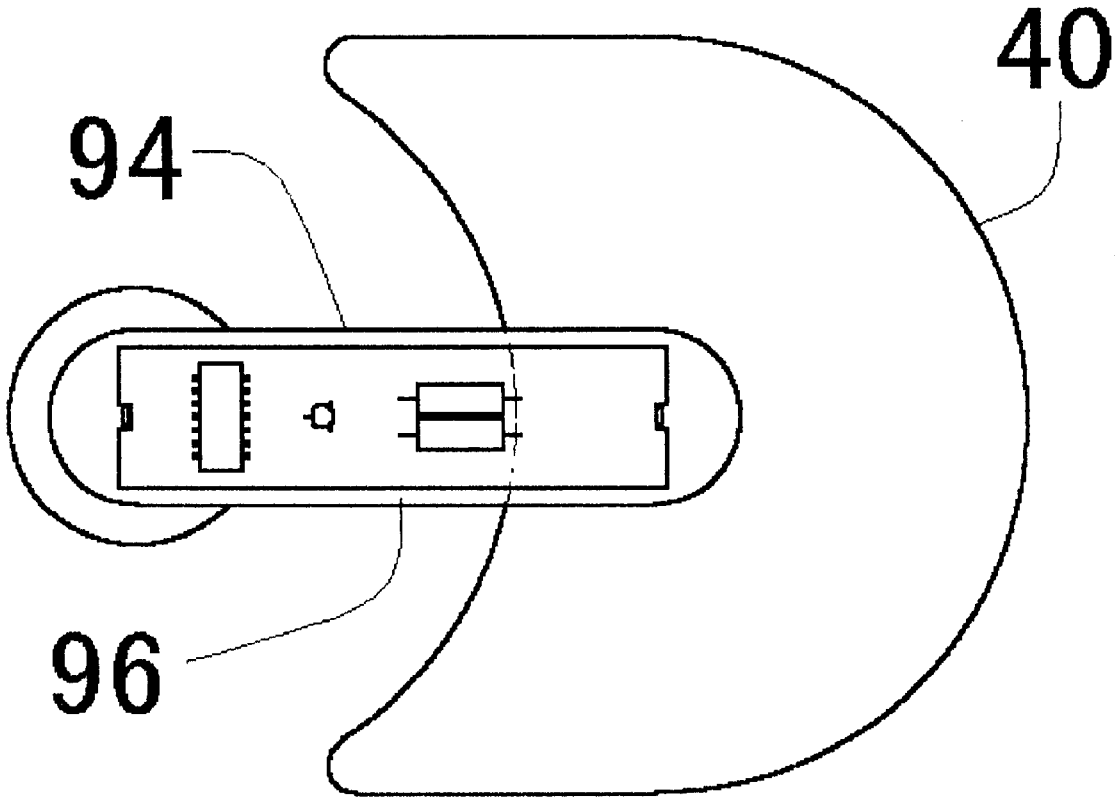
FIG. 24 is a bottom plan view of the same.

FIGS. 23 and 24 show a further alternative form of embodiment of the freshness managing member 48.

As illustrated, the freshness managing member 48 in this form of embodiment, rather than being attached to an upper conveyer element or crescent shaped plate 40 of the rotary crescent chain conveyer 22 as in the previous forms of embodiment and as shown in FIGS. 7 to 13, is attached to a link 94 as a lower element of the rotary crescent chain conveyer 22. In this case, the freshness managing member 48 is formed to correspond in shape to the lower link 94.

More specifically, the freshness managing member 48 has its body portion 96 that incorporates a microcomputer unit 50 and an ID medium 62 as freshness managing components, and the other freshness managing components including a warning device that emits light or sound, a lightness detecting means and a solar battery (illustration omitted) are attached to the upper conveyer element or plate 40 of the rotary conveyer 22.

The body portion 96 may be attached to the lower link 94 by engaging a raised periphery 64 formed on the lower link 94 and a stepped upper peripheral end 66 of the cup-shaped, and reversed freshness managing member 48 (facing upwards) with each other.

Using such an attachment structure makes it possible to attach a freshness managing member 48 to the lower link 94 that is located below the crescent shaped conveyer element 40.

The freshness managing member 48 in this form of embodiment may be used in the same manner as that shown in and described in connection with FIGS. 7 to 13.

Figure 25:
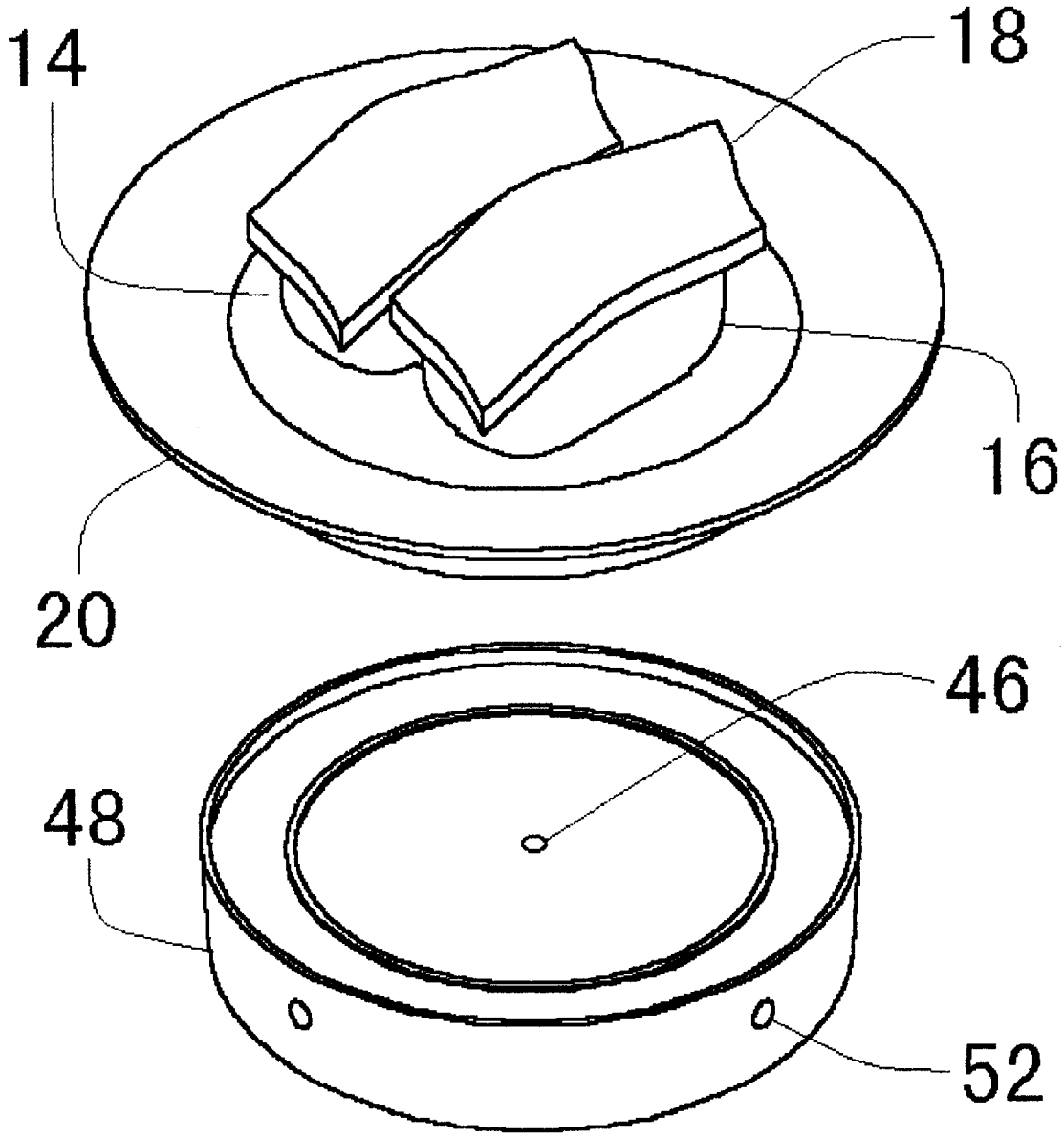
FIG. 25 is a perspective view illustrating a further alternative form of the freshness managing member according to the present invention, shown in relation to a merchandise item loaded tray.

FIG. 25 shows a further alternative form of embodiment of the freshness managing member 48.

As illustrated, the freshness managing member 48 in this form of embodiment while incorporating freshness managing components shown in and described in connection with FIGS. 7 to 13 is in the form of a cylindrical mount that can be supplied (loaded) thereon with a merchandise item tray 20 and can be placed on the rotary conveyer.

The freshness managing member 48 in this form of embodiment may be used in the same manner as shown in and described in connection with FIGS. 7 to 13, except that each freshness managing member 48 is placed on the rotary conveyer 22 and a merchandise item tray 20 is placed on each freshness managing member 48.

FIGS. 26 to 29 show another form of embodiment of the apparatus according to the present invention.

Figure 26:
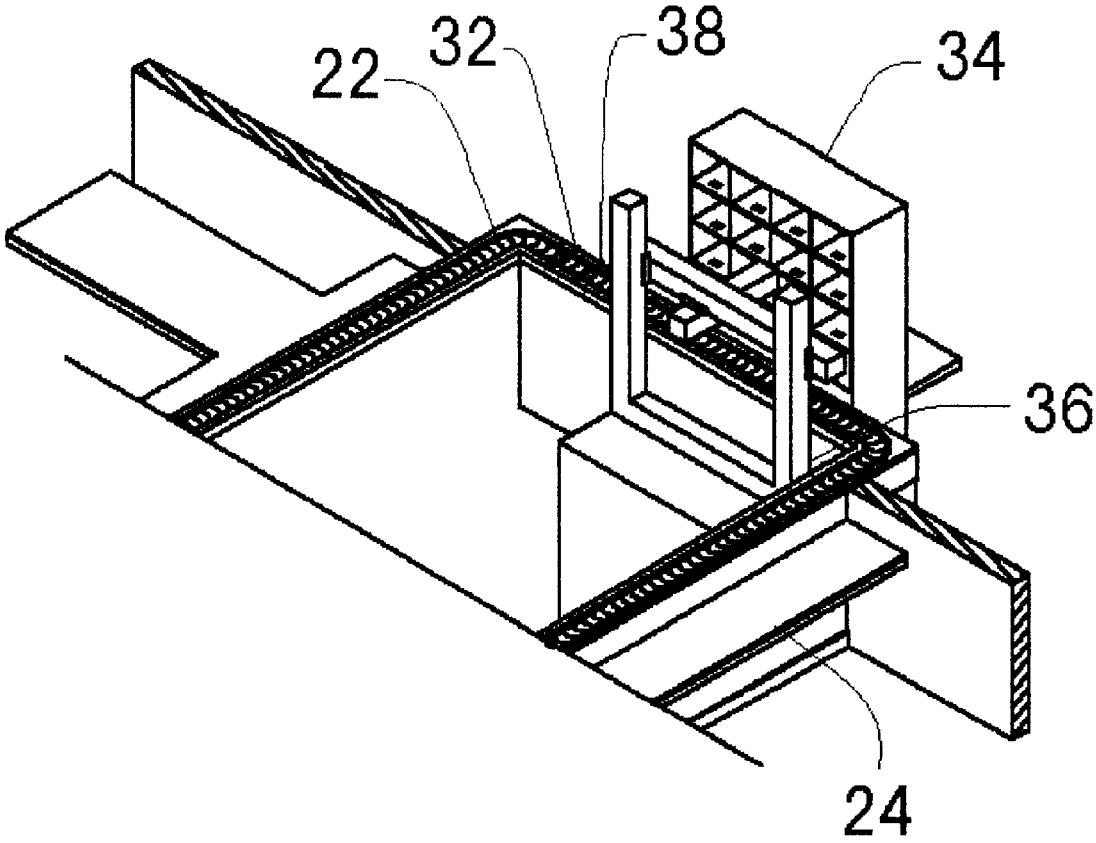
FIG. 26 is a perspective view of an alternative form of the merchandise item serving apparatus according to the present invention.
Figure 27:
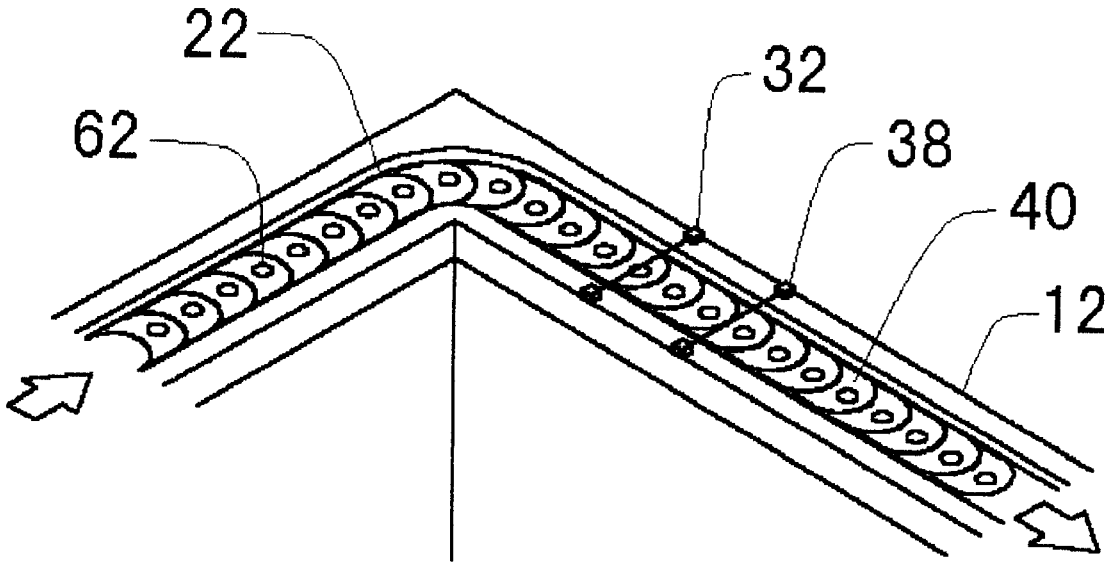
FIG. 27 is a perspective view illustrating a portion of the apparatus shown in FIG. 26, showing where a measuring and a detecting means may be located.

An apparatus in this form of embodiment is designed to facilitate introduction of an apparatus of the present invention described hereinbefore by a restaurant who has adopted a merchandise item tray 20 having an ID medium 62 attached thereto as shown in FIG. 27 to ease checking operation by a cashier. In this form of embodiment of the present invention, the lapse of time for a given merchandise item 14 placed on a corresponding merchandise item tray 20 that is counted from its loading into the merchandise item stocker 34 (FIG. 26) to its supply onto a corresponding freshness managing member 48 on the rotary conveyer 22 is added to the time elapsing for the merchandise item 14 conveyed around on the rotary conveyer 22 as carried on the freshness managing member 48 both to raise the accuracy of detection of freshness deterioration and to ease checking at the cashier for such merchandise items 14 taken by a guest. The construction of the apparatus is set forth below.

Figure 28:
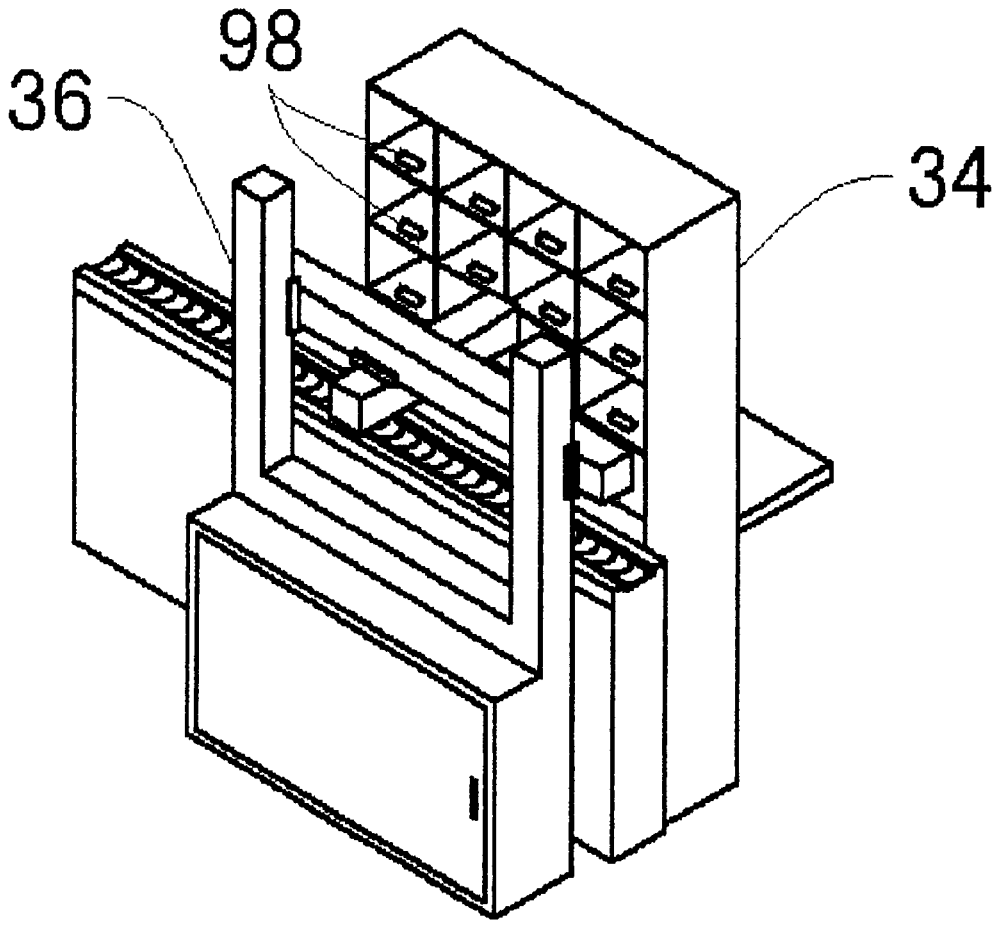
FIG. 28 is a perspective view of the apparatus, showing inter alia a merchandise item stocker.
Figure 29:
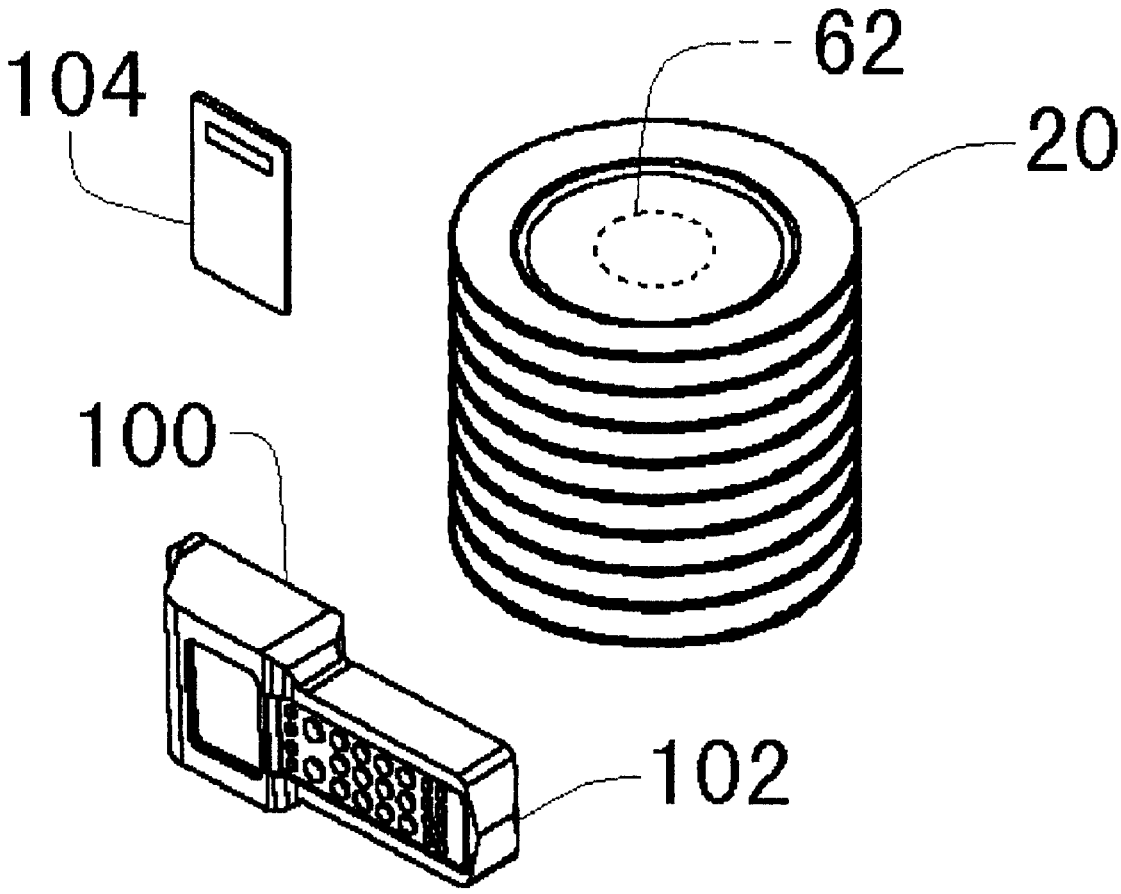
FIG. 29 is a perspective view diagrammatically illustrating the use of a readout sensor in checking a charge to a guest.

In addition to having the construction mentioned hereinbefore in connection with FIGS. 1 to 13, the present apparatus is designed to use a plastic merchandise item tray 20 having an ID medium 62 attached thereto as shown in FIG. 29, and includes an input device 98 that enters in the ID medium 62 merchandise item data such as the type, price and the allowable lapse of time of a merchandise item 14. The input device 98 is disposed in each section or compartment in the merchandise item stocker 34 as shown in FIG. 28.

Since the type of a merchandise item 14 to be loaded in each particular section or compartment in the merchandise item stocker 34 is predetermined, it suffices for the input device 98 to acquire information for an instant of time at which the merchandise item tray 20 is so loaded. The input device 98 may then enter the same together with the type and the price of the merchandise item 14 as the merchandise item data in the ID medium 62 of the merchandise item tray 20.

FIG. 29 also shows a measuring device 102 provided with a read sensor 100 that reads such merchandise item data entered in the ID medium 62 of each merchandise item tray 20.

The present form of embodiment may be practiced in the same manner as that shown in and described in connection with FIGS. 1 to 13 except that the lapse of time for each merchandise item 14 is measured, timed or counted starting at the point of time at which the merchandise item stocker 34 is loaded therewith and that the charge to a guest for the merchandise item trays 20 the guest took can be checked and determined by the measuring device 102. Mention is therefore made below with the primary emphasis placed on these respects.

First, as in the previous form of embodiment shown in and described in connection with FIG. 1 to 13, sections or compartments in the merchandise item stocker 34 are loaded type by type, with merchandise item trays 20 each having a merchandise item 14 placed thereon so that each section or compartment is loaded with a plurality of such merchandise trays 20 of a given merchandise item type.

Then, the input device 98 provided for each section or compartment in the merchandise item stocker 34 is used to enter the merchandise item data such as the type, price and loading time instant of the merchandise item 14 in the ID medium 62 for each individual merchandise tray 20 loaded in the section and compartment in the merchandise item stocker 34.

Then, the merchandise item feeder 36 as shown in FIG. 26 takes a merchandise item tray 20 with a give type of merchandise item 14 out of the merchandise item stocker 34, and measures and supplies the merchandise item tray 20 on a given freshness managing member 48. The merchandise item tray 20 is thus allowed to travel around on the rotary conveyer 22.

Either the measuring or detecting means 32 or 38 as shown in FIGS. 26 and 27 may be then used to continue to monitor the merchandise item data entered in the ID medium 62 of each such merchandise item tray 20 supplied and traveling around on the rotary conveyer 14, and to detect the presence of a merchandise item 14 that is deteriorating in freshness.

In this case, on account of entering the merchandise item loading time instant in the ID medium 62 of each merchandise item tray 20 when the merchandise item stocker 34 is loaded therewith, measuring the time period in which the merchandise item 14 on the same merchandise item tray 20 stored in the merchandise stocker 34, and adding that time period to the lapse of time of the merchandise item 14 on the same merchandise item tray 20 on the freshness managing member 48 traveling around on the rotary conveyer until its tendency to deteriorate in freshness is detected, an increased accuracy in detecting freshness deterioration is found achievable.

Also, in the present form of embodiment, the type, price and lapse of time of a merchandise item 14 placed on each merchandise item tray 20 can be managed individually. This makes it possible, from the standpoint of freshness management of merchandise items 14, to provide a warning device (illustration omitted) for the measuring or detecting means 32 or 38 and to provide an alert to the presence of a merchandise item 14 that is deteriorating in freshness, and thus to eliminate the need for freshness managing members 48. It then becomes possible to attach an ID medium 62 simply to a conveyer element 40 while omitting the freshness managing member 48.

Also, since the freshness managing member 48 if used may be used to manage or identify the type of a merchandise item 14 and to locate or designate the position of the merchandise item, it becomes possible to omit the warning device 44.

On the occasion of checking a charge to a guest, as shown in FIG. 29 the charge can be determined in a moment from a stack of merchandise item trays 20 the guest took, by disposing the measuring device 102 adjacent to the merchandise item trays 20 being placed one on top of another to have the read sensor 100 in the measuring device 102 read the merchandise item data entered in the ID medium 62 of each of the merchandise item trays 20.

An amount of money determined by the measuring device 102 may be recorded in a magnetic card as shown in FIG. 29. Alternatively, it may for example be recorded in bar codes, or printed in a slip.

Although the present invention has been described hereinbefore in terms of the presently preferred forms of embodiment, it is to be understood that such disclosure is purely illustrative and various alterations or modifications of, or additions to these forms of embodiment are possible.

For example, it will be obvious to omit the ID medium 62 attached to each merchandise item tray 20, to provide a time measuring means (illustration omitted) for each section or compartment in the merchandise item stocker 34, and to measure by this means the time period in which the merchandise item tray 20 remains stored therein. Then, an increased accuracy in detecting a merchandise item 14 that is deteriorating in freshness may be achieved if the microcomputer unit 50 as time measuring means or the ID medium 62 of the freshness managing member 48 being supplied with the merchandise item tray 20 by the merchandise item feeder 36 is used to write that storage time period.

It will also be obvious in FIGS. 1 to 17 that the rotary conveyer 22 is not limited to a crescent chain conveyer but may adopt a rotary mechanism than rotates around a loop using an endless chain or belt.

The sections or compartments in the merchandise item stocker 34 may not be declined towards the merchandise item feeder 36. This is particularly true if a mechanism is employed that enables a stored merchandise item tray 20 to move towards the merchandise item feeder 36.

Also, each section or compartment in the merchandise item stocker 34 need not necessarily be provided with a plurality of merchandise item trays 20 each loaded with a merchandise item 14 but may be provided with one such merchandise tray 20.

Also, although the merchandise item feeder 36 formed of a lift is shown, it may be any mechanism that is capable of taking out of the merchandise item stocker 34 merchandise item trays 20, one by one, each of which is loaded with a merchandise item 14 and moving them downwards.

Although in all the forms of embodiments illustrated merchandise items 14 are shown as supplied in part from the merchandise item supply zone 26 and in part from the merchandise item feed zone 30, this may be modified such that all the merchandise items 14 are supplied on measurement only from the merchandise item feed zone 30. It will then be seen that if merchandise item management data are constructed by the managing means 70 from data for the type of merchandise items 14 so supplied and their respective numbers, merchandise item management can be achieved, simply by entering those merchandise item management data in the merchandise item managing system 74.

It will also be obvious that the measuring and detecting means 32 and 38 may be unified when replaced by a single sensor that is able both to measure and to detect.

Also, while the light emitting diodes 52 in a freshness managing member 48 to alert to the presence of a merchandise item 14 deteriorating in freshness are caused first to emit light (light up or start turning on and off or flickering) when alerting to the presence of such a merchandise item 14, it should be noted that obviously it is also possible to cause all the light emitting diodes 52 in a freshness managing member 48 to light on or start turning on or off or flickering preliminarily when it is loaded with a merchandise item 14 and to cause these light emitting diodes 52 in the freshness managing member 48 to turn off or stop turning on and off or flickering successively as the time elapses and each of the light emitting diodes 52 in the freshness managing member 48 to turn off when a merchandise item 14 loaded thereon has had a given elapsed time and thus is deteriorating in freshness, thereby alerting to the presence of the merchandise item 14 deteriorating in freshness.

Also, the merchandise item tray 20 is conveniently a paper tray, but it may optionally be a plastic or ceramic tray.

Also, while the sense portion 42 of the freshness managing member 48 is shown and described to be a touch sensor, it may alternatively be a pressure switch capable of rising and sinking, or any mechanism having a functional ability to sense a merchandise item tray 20.

Also, while the warning means is shown and described to be a light emitting diode 52, it may be an illuminating lamp or any other device having a warning function, such as a device that emits, e.g., chimes or melodic sounds. The same may suitably be varied as to the number and location when arranged.

Also, while an arrangement has been shown and described that effects stepwise warning by way of changing the number of times of turning on and off of the light emitting diode 52, the location of a light emitting diode 52 turned on or off and/or the number of light emitting diodes 52 turned on or off in accordance with types of merchandise items 14, it will be obvious that an alternative arrangement may change the color of a light emitting diode or diodes 52 turned on in accordance with types of merchandise items 14.

It will also be apparent that the time interval of turning on and off the light emitting diode 52 can be set to vary with time periods elapsed, e.g., once in five (5) seconds if the elapsed time is 10 minutes and twice in 5 minutes if the elapsed time is 20 minutes to ease grasping lapses of time stepwise to allow merchandise item trays 20 to be recovered in order from those with merchandise items 14 that have stayed longer.

Also, it will be appreciated that checking the patterns of light emission (lighting-up or lighting-on and -off) of the light emitting diodes 52 of the warning devices 44 in the freshness managing members 48 on which are respectively placed the merchandise item trays 20 being conveyed by the rotary conveyer 22 turning around, allows the types of merchandise items 14 less frequently taken by guests (less salable or in less demand) and the types of merchandise items 14 frequently taken by guests (more salable or in greater demand) to be grasped well. On the basis of a state of sales thus grasped, the types of merchandise items 14 to be supplied and replenished can be determined to enable efficient preparation of merchandise items 14.

Also, while the power supply for each of the electrical components of the freshness managing member 48 is shown and described to be a solar battery 54 or a power generating mechanism 92, it may be a dry battery or dry cells. Then, it will be obvious that the freshness managing member 48 needs to be removed from the plate 22 for battery or cell replacement.

Also, while a color or pattern 56 is shown and described as applied to an identifier 58, it will be obvious that the color or pattern 56 may be applied directly to the cover member 68 or the conveyer element 40, and the identifier 58 may then be omitted.

It will also be obvious that the color or pattern 56 to be applied to the identifier 58 or the surface of the freshness managing member 48 may include a numeral or numerals or an alphabetic character or characters, or those characters in any language that represent the type or name of a particular "neta".

It will be obvious to omit the freshness managing mechanism incorporated in the freshness managing member 48 and then without primarily aiming to manage freshness, to attach to the freshness managing member 48 an identifier 58 having a color or pattern 56 applied thereto, or to apply a color or pattern 56 to a surface of the freshness managing member 48, thereby primarily aiming to offer merchandise items 14 abundant in type and efficiently.

It will also be obvious to omit the identifier 58 or the display plate 59 or the application of a color or pattern 56 to the freshness managing member 48 insofar as the omission still enables a merchandise item 14 that is deteriorating in freshness to be identified with ease.

Also, while a freshness managing member 48 is shown and described to be attached to a conveyer element 40 for each pair of adjacent conveyer element 40 and cover member 68, it will be obvious to attach a freshness managing member 48 to a conveyer element 40 for every two adjacent pairs of conveyer element 40 and cover member 68 and also to omit a cover member 68 and to attach a freshness managing member 48 to each of the conveyer element 40.

It should further be noted that the means for attaching the freshness managing member 48 and the cover member 68 to the conveyer element 40 is not limited to those illustrated. It may alternatively be such that an upper surface area of the conveyer element 40 is composed of ferrum and a magnet is attached to a rear surface area of each of the freshness managing member 48 and the cover member 68 (illustration omitted) so that the freshness managing member 48 and the cover member 68 may magnetically be attracted to the conveyer element 40. Obviously, it is also possible to employ any other configuration capable of attaching the freshness managing member 48 and the cover member 68 to the conveyer elements 40 of the rotary conveyer 22. It is obviously even possible not to attach but simply to place pairs of adjacent freshness managing members 48 and cover members 68 onto the conveyer elements 40 if they 48 and 68 are alternately interconnected.

Also, using an after-attachable mechanism with conveyer elements 40 as the means for attaching freshness managing members 48 and cover members 68 to conveyer elements 40 of a crescent chain rotary conveyer 22 allows the crescent chain conveyer 22 in an existing rotary catering table system in a restaurant to be replaced or modified with ease with a crescent chain conveyer 22 having freshness managing members 48 and cover members 68 attached thereto according to the present invention, thus to facilitate introducing the new system into an eating establishment equipped with the existing rotary catering table system and with greater ease and reduced cost.

Also, it will be obvious that having the operation of each freshness managing member 48 suspended by a cook, an operator or a worker after the business hours may allow removal of the lightness detecting means 46 from the freshness managing member 48.

It will be obvious to use a microcomputer, microprocessor unit or units (MPU) or any other processing apparatus to constitute the processing means 70.

It will also be obvious to omit the ID media 62, the measuring means 32, the detector means 38 and the processing means 70 and the warning device 44 alone of each freshness managing member 48 to enable an operator to monitor and locate the type of merchandise items 14 that are becoming short in supply, and the presence of a merchandise item 14 that is deteriorating in freshness, and to check the types of merchandise items 14 taken by guests and their respective numbers and the types of merchandise items 14 recovered and also to check the sales figures in the restaurant.

It will also be obvious to omit the freshness managing members 48 while using the processing means 70, the measuring means 32 and the detecting means 38 in alerting an operator to the presence of a merchandise item 14 that is deteriorating in freshness.

It should also be noted that the merchandise item 14 is not limited to a sushi item as illustrated that has its shari 16 topped with its neta 18 such as a sashimi piece and that is offered as placed on the merchandise item tray 20. Optionally it may also be, for example, a "yakimono" (broiled food) or agemono (fried food) item that is offered as placed on a piece of tableware such as a hot plate which can in turn be placed anywhere on a pair of adjacent freshness managing member 48 and cover member 68. If the merchandise item is thus a yakimono or agemono item, it is obvious that its freshness can be managed or checked by alerting to the fact that it is lowering in temperature and thus deteriorating in freshness as indicated by a predetermined lapse of time after its supply.

It should further be noted that the apparatus that can be used to carry out the method according to the present invention is not limited to those illustrated.

It is further to be noted that methods and apparatuses set forth in the appended claims can be in any possible combination.

There have been shown and described improved methods of and apparatus for serving merchandise items for use in a rotary catering table system having a rotary conveyer lane disposed in a top area of a base stand and on which merchandise items are conveyed around, and a novel merchandise item management system for a plurality of restaurants each provided with a rotary catering table device as described.

According to one aspect of the present invention, the rotary conveyer lane is served with merchandise items automatically from a merchandise item stocker and therefore served very efficiently.

Also, making the merchandise item stocker in the form of a three-dimensional structure as described before gives more than clear information as to the types and numbers of the merchandise items stored in the merchandise item stocker and permits the presence or absence in any of the storage compartments or sections therein of a given merchandise item to be checked in a moment. Therefore, to check the types of merchandise items that are becoming short and to check particular places to be supplied with merchandise items prepared, the need so far met to look over the entire area of the rotary conveyer or to watch a monitor are altogether eliminated. Thus, even an inexperienced operator such as a short term employment worker may sufficiently recognize types of merchandise items that are becoming short. The operator may simply be in front of the merchandise item stocker to check the presence or absence in any of the storage compartments or sections therein of a given merchandise item, and may prepare one absent in a section and provide the section therewith. It thus becomes possible to offer merchandise items with an enhanced efficiency.

In this case, efficiency of storage is achieved by making the combination of types of merchandise items for storage in the merchandise item stocker proper according to the time zone in the business hours and the guests' favorite food, and changing the number of storage compartments or sections to be greater for types of merchandise items to be consumed more abundantly and to be smaller for those to be consumed less abundantly.

The rotary conveyer is automatically served with merchandise items by a unique combination of a measuring means that determines the types of merchandise items conveyed around on the rotary conveyer and their respective numbers, and a merchandise item feeder that supplies the rotary conveyer with merchandise items of the types that are determined as becoming short of supply in number from a specified number.

Also here, since a merchandise item of a particular type is supplied by the merchandise item feeder at a place on the rotary conveyer that is found by a detector means to be devoid of a merchandise item of that particular type, the need to visually find such a place is altogether eliminated and working efficiency is improved.

Also, the rotary conveyer is provided with a recovery zone and an additional supply zone where a skilled sushi cook demonstrating his sophisticated preparation technique serves guests and/or the rotary conveyer with merchandise items while preparing them. Providing such a supply zone would help or provoke guests to enjoy dining by realizing that they are offered with merchandise items prepared by such skill and would in turn promote a rise in the sales of the restaurant.

Providing the recovery zone facilitates recovering the merchandise items that are deteriorating in freshness and permits these merchandise items to be managed with certainty both in type and number.

Also, in contrast to the conventional merchandise item freshness managing practice that has had to rely on a rule of thumb possessed by an operator, the use of a freshness managing member that measures time elapsing for a merchandise item supplied and issues a warning about a predetermined lapse of time after supply and alerts to the presence of merchandise item that remains uneaten by any guest and continues to pass around as carried by the rotary conveyer, i.e., deteriorating in freshness, requires the operator to do nothing other than to recover a particular merchandise item alerted to by the freshness managing member, and makes it extremely easier to check merchandise items that are deteriorating in freshness. Furthermore, eliminating the possibility for a guest to take any merchandise item that is deteriorating in freshness and to be poisoned thereby, an extremely hygienic catering system is provided.

Also, applying a color or pattern to a conveyer element (or freshness managing member) at least on a surface thereof or attaching thereto an identifier having a color or pattern applied thereto, or attaching thereto a display plate that displays the type of merchandise item and supplying the freshness managing member with a merchandise item of the type that corresponds to and is designated by the color or pattern or the display of the display plate permits diversified types of merchandise items to be offered in sequence and the pattern of arrangement to be changed in which they are offered in sequence depending on seasons, days of the week and/or time zones, e.g., in the daytime zone, lower-priced merchandise items to be offered more abundantly and in the evening time zone, merchandise items over the entire price range more abundantly in type to be offered. And, arranging a series of sequences of freshness managing members with identical and different colors or patterns established in the manner that a first sequence of freshness managing members of a given number and one given color is followed by a second sequence of freshness managing members of a given number and another given color or pattern and so forth interchangeably in a pattern as it fits allows merchandise items to be offered efficiently and abundantly in type to guests, thus enabling a guest at any time to choose to take any one of its favor from merchandise items abundant and diversified in type, and thereby to enjoy dining. A rise in guest turnover and sales figures can in turn come about.

Also, the operator is enabled to identify types of merchandise items that are becoming in short supply by checking the color or pattern applied to each of the conveyer elements, the freshness managing members or the identifiers not loaded with merchandise item trays. The operator may then simply replenish merchandise items of the types that are becoming short in supply and does not need to take an extensive view over the entire area of the rotary conveyer as has so far been the case, to grasp merchandise items of the types that are becoming short in supply. Advantages are achieved, therefore, of sharply reducing the load so far imposed on the operator in replenishing merchandise items, and of offering merchandise items with an increased efficiency.

Further, detachably attaching an identifier to each freshness managing member allows such an identifier to be readily detached from one freshness managing member and to be readily attached to another freshness managing member and thus the pattern of arrangement of such identifiers to be readily altered from one to another.

Also, attaching a display plate that displays the type of a merchandise item to be supplied to a conveyer element or a freshness managing member eliminates altogether the need to exchange identifier or freshness managing members having colors or patterns applied respectively thereto when the pattern of arrangement of merchandise items conveyed around should be altered, and makes the use of a processing means then sufficient to do so in a moment.

Also, incorporating into a freshness managing member an ID medium capable of recording each type of merchandise items, providing a measuring means for determining the ID medium and a detecting means for detecting the presence and absence of a merchandise item over the conveyer element or the freshness managing member and connecting these means to a processing means for indicating the type of merchandise items to be supplied (becoming in short supply) permit those types of merchandise items and their respective numbers to be readily identified. As a result, servability of merchandise items is improved.

Further, pre-registering data for all of the ID media incorporated in the freshness managing members allows the types of merchandise items supplied on the freshness managing members and their respective numbers and prices to be confirmed in real time and in turn the sales of the restaurant to be managed.

Also, by attaching an ID medium to only one of adjacent conveyer elements or attaching a freshness managing member to one of them and to the other a cover member devoid of any freshness managing mechanism, respectively, not only is the number of freshness managing members or the identifiers used reduced, but also a large reduction in cost is achieved compared with the arrangement in which an expensive ID medium that is increasingly used in the recent years is individually attached to each merchandise item tray.

Also, supplying a merchandise item loaded tray onto a freshness managing member and an adjacent cover plate each attached to a conveyer element, eliminates the need to center the tray on the freshness managing member thereby enabling the merchandise item loaded tray to be placed anywhere on the freshness managing member and the cover plate while still permitting the freshness managing member to be sensitive to the merchandise item loaded tray. The results are a sharp decrease in the work load imposed on supplying and replenishing merchandise items and a rise in the ability to furnish with merchandise items.

Further, in alerting by light emission to the presence of a merchandise item that is deteriorating in freshness, the presence of such a merchandise item can advantageously be so alerted to by changing the time interval of turning a light on and off, the location of lights, the number of lights and the color lit in accordance with types of merchandise items. This facilitates type by type grasping of merchandise items deteriorating in freshness and provides their efficient recovery.

Also, checking the patterns of light emission (lighting-up or lighting-on and -off) of the warning devices in the freshness managing members allows the types of merchandise items less frequently taken by guests (less salable or in less demand) and the types of merchandise items frequently taken by guests (more salable or in greater demand) to be grasped well. On the basis of a state of sales thus grasped, the types of merchandise items to be supplied and replenished can be determined, thus enabling efficient preparation of merchandise items.

Also, providing each freshness managing member with the ability to sense lightness in the restaurant makes its freshness managing function active only in the time zone of the business hours of the restaurant in which its inside is light and inactive in the time zone outside the business hours of the restaurant in which its inside is dark. This has the effect of saving power consumption entailed in the freshness managing (alerting) operation.

Further, by changing the threshold lapse of time for a merchandise item from supply thereof, it becomes possible to manage freshness of merchandise items with sureness according to the season.

Also, an ID medium may be attached to a merchandise item tray for placing a merchandise item thereon. The ID medium may be entered with the type and price of the merchandise item as well as the time at which the merchandise item is prepared and loaded on the merchandise tray. Then, since the lapse of time can be determined as well of a merchandise item before it is supplied onto the rotary conveyer, the accuracy of detecting deterioration of its freshness is increased. Moreover, charge determination in checking at a cashier is facilitated.

Further, a highly advantageous merchandise item management system is provided that is operable for execution on or with an information communication network, and which comprises a merchandise managing means and a merchandise ordering means. The merchandise managing means is designed to build merchandise management data, on the basis of which merchandise is ordered item by item from a plurality of suppliers. Thus, in each member restaurant data for merchandise item supply by the merchandise item feeder may be automatically entered in the merchandise managing means. Then, the merchandise managing means in the restaurant is automatically operated to build corresponding merchandise management data, on the basis of which the merchandise ordering means is operated to order merchandise or merchandise item materials from suppliers. The system therefore eliminates the burdens altogether, which have been imposed on each restaurant in getting merchandise materials by going to a market and ordering by telephone. On the side of a member supplier, the accuracy of arranging for and delivering merchandise items ordered is assured by reason of the fact that they are ordered from the supplier by the merchandise item ordering means in a member restaurant.

Although the present invention has been described hereinbefore in terms of the presently preferred forms of embodiment, it is to be understood that such disclosure is purely illustrative and is not to be interpreted as limiting. Consequently, without departing from the spirit and scope of the invention, various alterations, modifications, and/or alternative applications of the invention will, no doubt, be suggested to those skilled in the art after having read the preceding disclosure. Accordingly, it is intended that the following claims be interpreted as compassing all alterations, modifications, or alternative applications not explicitly disclosed hereinbefore as fall within the true spirit and scope of the invention.

What is claimed is:

1. In a rotary catering table system having a rotary conveyer lane (22) disposed in a top area of a base stand (12) and on which merchandise items (14) are conveyed around, a method of serving merchandise items, comprising:

disposing a merchandise item stocker (34) adjacent to the rotary conveyer lane (22), the merchandise item stocker (34) having a plurality of compartments defined by rows and tiers and adapted to store therein merchandise items (14) classified by type;

disposing a merchandise item feeder (36) adjacent both the stocker (34) and the rotary conveyer lane (22), the merchandise item feeder (36) being operable to select a merchandise item (14) from those stored in the merchandise item stocker (34) and to transfer the selected merchandise item (14) onto the rotary conveyer lane (22);

by means of said merchandise item feeder (36), automatically serving the rotary conveyer lane (22) with merchandise items (14);

by means of a measuring means (32), determining types of merchandise items (14) being conveyed around on the rotary conveyer lane (22) and their respective numbers; and by means of said merchandise item feeder (36), determining which specified types of merchandise items (14) on the rotary conveyer lane (22) are becoming short of supply in number each from a specified number, and transferring as said selected merchandise item (14) a merchandise item (14) of a type so determined from the merchandise item stocker (34) onto the rotary conveyer lane (22).

2. A method of serving merchandise items in a rotary catering table system, as set forth in claim 1, further comprising:

by means of a detecting means (38), determining a place on the rotary conveyer lane (22) at which a merchandise item (14) is lacking; and by means of said merchandise item feeder (36), replenishing said place determined on the rotary conveyer lane (22) with a merchandise item (14) from said merchandise item stocker (34).

3. A method of serving merchandise items in a rotary catering table system, as set forth in claim 1, further comprising:

providing the rotary conveyer lane (22) with a merchandise item supply zone (26) to be served with a merchandise item (14) manually by an operator and a merchandise item recovery zone (28) at which to recover a merchandise item (14) that is deteriorating in freshness; and providing each of said zones (26, 28) with a measuring means (32) for determining types of merchandise items (14) with which the supply zone (6) is served and their respective numbers and types of merchandise items (14) recovered in the recovery zone (28) and their respective numbers, respectively, whereby merchandise items (12) turned around on the rotary conveyer lane (22) are managed.

4. A method of serving merchandise items in a rotary catering table system as set forth in claim 1, further comprising:

fitting an ID medium (62) to a merchandise item tray (20) having a merchandise item (14) placed thereon, the ID medium (62) having a type, price or allowable lapse of time of the merchandise item (14) registered therein.

5. In a rotary catering table system having a rotary conveyer lane (22) disposed in a top area of a base stand (12) and on which merchandise items (14) are conveyed around, a method of serving merchandise items, comprising:

disposing a merchandise item stocker (34) adjacent to the rotary conveyer lane (22), the merchandise item stocker (34) having a plurality of compartments defined by rows and tiers and adapted to store therein merchandise items (14) classified by type;

disposing a merchandise item feeder (36) adjacent both the stocker (34) and the rotary conveyer lane (22), the merchandise item feeder (36) being operable to select a merchandise item (14) from those stored in the merchandise item stocker (34) and to transfer the selected merchandise item (14) onto the rotary conveyer lane (22);

by means of said merchandise item feeder (36), automatically serving the rotary conveyer lane (22) with merchandise items (14);

by means of a detecting means (38), determining a place on the rotary conveyer lane (22) at which a merchandise item (14) is lacking; and by means of said merchandise item feeder (36), replenishing said place determined on the rotary conveyer lane (22) with a merchandise item (14) from said merchandise item stocker (34).

6. A method of serving merchandise items in a rotary catering table system as set forth in claim 5, further comprising:

fitting conveyer elements (40) forming the rotary conveyer lane (22) as a rotary conveyer with ID media (62) each of which is capable of registering a type of a merchandise item (14);

disposing adjacent to the rotary conveyer (22) measuring means (32) adapted to measure the ID media (62) and detecting means (38) adapted to determine the presence or absence of a merchandise item on or above each of the conveyer elements (40);

connecting said measuring means (32) and detecting means (38) to a processing means (70) for indicating a type of merchandise items (14);

by means of the processing means, determining which specified types of merchandise items (14) on the rotary conveyer lane (22) are becoming short of supply in number each from a specified number; and supplying the rotary conveyer lane (22) with a merchandise item (14) of a type so determined on a conveyer element (40) designated.

7. A method of serving merchandise items in a rotary catering table system as set forth in claim 6, wherein only one of each adjacent pair of the conveyer elements (40) is fitted with an ID medium (62), thereby reducing the number of the ID media (62) used.

8. A method of serving merchandise items in a rotary catering table system as set forth in claim 7, wherein a warning is issued for each type of merchandise items (14) by emitting a light that varies in flickering time interval, number of light emissions or color depending on types of merchandise items (14).

9. A method of serving merchandise items in a rotary catering table system as set forth in claim 8, further comprising:

detecting lightness in environment of the rotary catering table and suspending issuance of said warning in a time zone outside of the business hours in which the environment is dark.

10. A method of serving merchandise items in a rotary catering table system as set forth in claim 7, further comprising:

fitting an ID medium (62) to a merchandise item tray (20) having a merchandise item (14) placed thereon, the ID medium (62) having a type, price or allowable lapse of time of the merchandise item (14) registered therein.

11. A method of serving merchandise items in a rotary catering table system as set forth in claim 6, wherein each adjacent pair of the conveyer elements (40) is fitted with a freshness managing member (48) and with a cover member (68) having no freshness managing means attached thereto, respectively, thereby reducing the number of the freshness managing members (48) used.

12. A method of serving merchandise items in a rotary catering table system as set forth in claim 11, further comprising:

by means of each of the freshness managing members (48), detecting lightness in environment of the rotary catering table and suspending the freshness managing members (48) from issuing a warning in a time zone outside of business hours in which the environment is dark.

13. A method of serving merchandise items in a rotary catering table system as set forth in claim 11, further comprising:

fitting an ID medium (62) to a merchandise item tray (20) having a merchandise item (14) placed thereon, the ID medium (62) having a type, price or allowable lapse of time of the merchandise item (14) registered therein.

14. A method of serving merchandise items in a rotary catering table system as set forth in claim 6, wherein a warning is issued for each type of merchandise items (14) by emitting a light that varies in flickering time interval, number of light emissions or color depending on types of merchandise items (14).

15. A method of serving merchandise items in a rotary catering table system as set forth in claim 14, further comprising:

detecting lightness in environment of the rotary catering table and suspending issuance of said warning in a time zone outside of business hours in which the environment is dark.

16. A method of serving merchandise items in a rotary catering table system as set forth in claim 6, further comprising:

fitting an ID medium (62) to a merchandise item tray (20) having a merchandise item (14) placed thereon, the ID medium (62) having a type, price or allowable lapse of time of the merchandise item (14) registered therein.

17. A method of serving merchandise items in a rotary catering table system as set forth in claim 5, further comprising:

fitting the rotary conveyer lane with freshness managing members;

fitting the freshness managing members (48) with ID media (62) each of which is capable of registering a type of a merchandise item (14);

disposing adjacent to the rotary conveyer (22) measuring means (32) adapted to measure the ID media (62) and detecting means (38) adapted to determine the presence or absence of a merchandise item on or above each of the freshness managing members (48);

connecting said measuring means (32) and detecting means (38) to a processing means (70) for indicating a type of merchandise items (14);

by means of the processing means, determining which specified types of merchandise items (14) on the rotary conveyer lane (22) are becoming short of supply in number each from a specified number; and supplying the rotary conveyer lane (22) with a merchandise item (14) of a type so determined on a freshness managing member (48) designated.

18. A method of serving merchandise items in a rotary catering table system as set forth in claim 17, further comprising:

providing conveyer elements (40) to form the rotary conveyer lane (22), wherein each adjacent pair of the conveyer elements (40) is fitted with a freshness managing member (48) and with a cover member (68) having no freshness managing means attached thereto, respectively, thereby reducing the number of the freshness managing members (48) used.

19. A method of serving merchandise items in a rotary catering table system as set forth in claim 17, wherein a warning is issued for each type of merchandise items (14) by emitting a light that varies in flickering time interval, number of light emissions or color depending on types of merchandise items (14).

20. A method of serving merchandise items in a rotary catering table system as set forth in claim 19, further comprising:

by means of each of the freshness managing members (48), detecting lightness in environment of the rotary catering table and suspending the freshness managing members (48) from issuing said warning in a time zone outside of business hours in which the environment is dark.

21. A method of serving merchandise items in a rotary catering table system as set forth in claim 17, further comprising:

fitting an ID medium (62) to a merchandise item tray (20) having a merchandise item (14) placed thereon, the ID medium (62) having a type, price or allowable lapse of time of the merchandise item (14) registered therein.

22. A method of serving merchandise items in a rotary catering table system, as set forth in claim 5, further comprising:

providing the rotary conveyer lane (22) with a merchandise item supply zone (26) to be served with a merchandise item (14) manually by an operator and a merchandise item recovery zone (28) at which to recover a merchandise item (14) that is deteriorating in freshness; and providing each of said zones (26, 28) with a measuring means (32) for determining types of merchandise items (14) with which the supply zone (6) is served and their respective numbers and types of merchandise items (14) recovered in the recovery zone (28) and their respective numbers, respectively, whereby merchandise items (12) turned around on the rotary conveyer lane (22) are managed.

23. A method of serving merchandise items in a rotary catering table system as set forth in claim 5, further comprising:

fitting an ID medium (62) to a merchandise item tray (20) having a merchandise item (14) placed thereon, the ID medium (62) having a type, price or allowable lapse of time of the merchandise item (14) registered therein.

24. In a rotary catering table system having a rotary conveyer lane (22) disposed in a top area of a base stand (12) and on which merchandise items (14) are conveyed around, a method of serving merchandise items, comprising:

disposing a merchandise item stocker (34) adjacent to the rotary conveyer lane (22), the merchandise item stocker (34) having a plurality of compartments defined by rows and tiers and adapted to store therein merchandise items (14) classified by type;

disposing a merchandise item feeder (36) adjacent both the stocker (34) and the rotary conveyer lane (22), the merchandise item feeder (36) being operable to select a merchandise item (14) from those stored in the merchandise item stocker (34) and to transfer the selected merchandise item (14) onto the rotary conveyer lane (22);

by means of said merchandise item feeder (36), automatically serving the rotary conveyer lane (22) with merchandise items (14);

providing the rotary conveyer lane (22) with a merchandise item supply zone (26) to be served with a merchandise item (14) manually by an operator and a merchandise item recovery zone (28) at which to recover a merchandise item (14) that is deteriorating in freshness; and providing each of said zones (26, 28) with a measuring means (32) for determining types of merchandise items (14) with which the supply zone (6) is served and their respective numbers and types of merchandise items (14) recovered in the recovery zone (28) and their respective numbers, respectively, whereby merchandise items (12) turned around on the rotary conveyer lane (22) are managed.

25. A method of serving merchandise items in a rotary catering table system as set forth in claim 24, further comprising:

fitting conveyer elements (40) forming the rotary conveyer lane (22) as a rotary conveyer with ID media (62) each of which is capable of registering a type of a merchandise item (14);

disposing adjacent to the rotary conveyer (22) measuring means (32) adapted to measure the ID media (62) and detecting means (38) adapted to determine the presence or absence of a merchandise item on or above each of the conveyer elements (40);

connecting said measuring means (32) and detecting means (38) to a processing means (70) for indicating a type of merchandise items (14);

by means of the processing means, determining which specified types of merchandise items (14) on the rotary conveyer lane (22) are becoming short of supply in number each from a specified number; and supplying the rotary conveyer lane (22) with a merchandise item (14) of a type so determined on a conveyer element (40) designated.

26. A method of serving merchandise items in a rotary catering table system as set forth in claim 24, further comprising:

fitting the rotary conveyer lane with freshness managing members;

fitting the freshness managing members (48) with ID media (62) each of which is capable of registering a type of a merchandise item (14);

disposing adjacent to the rotary conveyer (22) measuring means (32) adapted to measure the ID media (62) and detecting means (38) adapted to determine the presence or absence of a merchandise item on or above each of the freshness managing members (48);

connecting said measuring means (32) and detecting means (38) to a processing means (70) for indicating a type of merchandise items (14);

by means of the processing means, determining which specified types of merchandise items (14) on the rotary conveyer lane (22) are becoming short of supply in number each from a specified number; and supplying the rotary conveyer lane (22) with a merchandise item (14) of a type so determined a freshness managing member (48) designated.

27. A method of serving merchandise items in a rotary catering table system as set forth in claim 24, further comprising:

fitting an ID medium (62) to a merchandise item tray (20) having a merchandise item (14) placed thereon, the ID medium (62) having a type, price or allowable lapse of time of the merchandise item (14) registered therein.

28. In a rotary catering table system having a rotary conveyer lane (22) disposed in a top area of a base stand (12)

and on which merchandise items (14) are conveyed around, a method of serving merchandise items, comprising:

fitting the rotary conveyer lane (22) with freshness managing members (48);

serving the rotary conveyer lane (22) that is fitted with the freshness managing members (48), with merchandise items (14), the freshness managing members (48) being each operable for actuation upon supply with a merchandise item (14) for measuring time elapsing for the merchandise item (14) after supply and each operable to issue a warning upon a predetermined lapse of time after the supply; and by way of such a warning by said freshness managing members (48), alerting to the presence of a merchandise item (14) that is deteriorating in freshness.

29. A method of serving merchandise items in a rotary catering table system as set forth in claim 25, wherein said warning is issued for each type of merchandise items (14) by emitting a light that varies in flickering time interval, number of light emissions or color depending on types of merchandise items (14).

30. A method of serving merchandise items in a rotary catering table system as set forth in claim 29, further comprising:

by means of each of the freshness managing members (48), detecting lightness in environment of the rotary catering table and suspending the freshness managing members (48) from issuing said warning in a time zone outside of business hours in which the environment is dark.

31. A method of serving merchandise items in a rotary catering table system as set forth in claim 29, further comprising:

fitting an ID medium (62) to a merchandise item tray (20) having a merchandise item (14) placed thereon, the ID medium (62) having a type, price or allowable lapse of time of the merchandise item (14) registered therein.

32. A method of serving merchandise items in a rotary catering table system as set forth in claim 28, further comprising:

by means of each of the freshness managing members (48), detecting lightness in environment of the rotary catering table and suspending the freshness managing members (48) from issuing said warning in a time zone outside of business hours in which the environment is dark.

33. A method of serving merchandise items in a rotary catering table system as set forth in claim 32, further comprising:

fitting an ID medium (62) to a merchandise item tray (20) having a merchandise item (14) placed thereon, the ID medium (62) having a type, price or allowable lapse of time of the merchandise item (14) registered therein.

34. A method of serving merchandise items in a rotary catering table system as set forth in claim 28, further comprising:

fitting conveyer elements (40) forming the rotary conveyer lane (22) as a rotary conveyer with ID media (62) each of which is capable of registering a type of a merchandise item (14);

disposing adjacent to the rotary conveyer (22) measuring means (32) adapted to measure the ID media (62) and detecting means (38) adapted to determine the presence or absence of a merchandise item on or above each of the conveyer elements (40);

connecting said measuring means (32) and detecting means (38) to a processing means (70) for indicating a type of merchandise items (14);

by means of the processing means, determining which specified types of merchandise items (14) on the rotary conveyer lane (22) are becoming short of supply in number each from a specified number; and supplying the rotary conveyer lane (22) with a merchandise item (14) of a type so determined on a conveyer element (40) designated.

35. A method of serving merchandise items in a rotary catering table system as set forth in claim 28, further comprising:

fitting the freshness managing members (48) with ID media (62) each of which is capable of registering a type of a merchandise item (14);

disposing adjacent to the rotary conveyer (22) measuring means (32) adapted to measure the ID media (62) and detecting means (38) adapted to determine the presence or absence of a merchandise item on or above each of the freshness managing members (48);

connecting said measuring means (32) and detecting means (38) to a processing means (70) for indicating a type of merchandise items (14);

by means of the processing means, determining which specified types of merchandise items (14) on the rotary conveyer lane (22) are becoming short of supply in number each from a specified number; and supplying the rotary conveyer lane (22) with a merchandise item (14) of a type so determined on a freshness managing member (48) designated.

36. A method of serving merchandise items in a rotary catering table system as set forth in claim 28 further comprising:

fitting an ID medium (62) to a merchandise item tray (20) having a merchandise item (14) placed thereon, the ID medium (62) having a type, price or allowable lapse of time of the merchandise item (14) registered therein.

37. In a rotary catering table system having a rotary conveyer lane (22) disposed in a top area of a base stand (12) and on which merchandise items (14) are conveyed around, an apparatus for serving the rotary conveyer lane with merchandise items, comprising:

a merchandise item stocker (34) disposed adjacent to the rotary conveyer lane (22), the merchandise item stocker (34) having a plurality of compartments defined by rows and tiers and adapted to store therein merchandise items (14) classified by type;

a merchandise item feeder (36) disposed adjacent both the stocker (34) and the rotary conveyer lane (22), the merchandise item feeder (36) being operable to select a merchandise item (14) from those stored in the merchandise item stocker (34) and to transfer the selected merchandise item (14) onto the rotary conveyer lane (22), thereby automatically serving the rotary conveyer lane (22) with merchandise items (14); and fitting an ID medium (62) to a merchandise item tray (20) having a merchandise item (14) placed thereon, the ID medium (62) having a type, price or allowable lapse of time of the merchandise item (14) registered therein.

38. In a rotary catering table system having a rotary conveyer lane (22) disposed in a top area of a base stand (12) and on which merchandise items (14) are conveyed around, an apparatus for serving the rotary conveyer lane with merchandise items, comprising:

a merchandise item stocker (34) disposed adjacent to the rotary conveyer lane (22), the merchandise item stocker

(34) having a plurality of compartments defined by rows and tiers and adapted to store therein merchandise items (14) classified by type;

a merchandise item feeder (36) disposed adjacent both the stocker (34) and the rotary conveyer lane (22), the merchandise item feeder (36) being operable to select a merchandise item (14) from those stored in the merchandise item stocker (34) and to transfer the selected merchandise item (14) onto the rotary conveyer lane (22), thereby automatically serving the rotary conveyer lane (22) with merchandise items (14);

a measuring means (32) for determining types of merchandise items (14) being conveyed around on the rotary conveyer lane (22) and their respective numbers, and wherein said merchandise item feeder (36) is adapted to determine which specified types of merchandise items (14) on the rotary conveyer lane (22) are becoming short of supply in number each from a specified number, and to transfer as said selected merchandise item (14) a merchandise item (14) of a type so determined from the stocker (34) onto the rotary conveyer lane (22).

39. An apparatus for serving merchandise items in a rotary catering table system, as set forth in claim 38, further comprising:

a detecting means (38) for determining a place on the rotary conveyer lane (22) at which a merchandise item (14) is lacking, and wherein said merchandise item feeder (36) is adapted to replenish said place determined on the rotary conveyer lane (22) with a merchandise item (14) from said merchandise item stocker (34).

40. An apparatus for serving merchandise items in a rotary catering table system, as set forth in claim 38, wherein the rotary conveyer lane (22) is provided with a merchandise item supply zone (26) to be served with a merchandise item (14) manually by an operator and a merchandise item recovery zone (28) where a merchandise item (14) is recovered that is deteriorating in freshness, the apparatus further comprising:

a first measuring means (32) for determining types of merchandise items (14) with which the supply zone (26) is served and their respective numbers; and a second measuring means (32) for determining types of merchandise items (14) recovered in the recovery zone (28) and their respective numbers, whereby merchandise items (12) turned around on the rotary conveyer lane (22) are managed.

41. An apparatus for serving merchandise items in a rotary catering table system as set forth in claim 38, further comprising an ID medium (62) fitted to a merchandise item tray (20) having a merchandise item (14) placed thereon, the ID medium having a type, price or allowable lapse of time of the merchandise item (14) registered therein.

42. In a rotary catering table system having a rotary conveyer lane (22) disposed in a top area of a base stand (12) and on which merchandise items (14) are conveyed around, an apparatus for serving the rotary conveyer lane with merchandise items, comprising:

a merchandise item stocker (34) disposed adjacent to the rotary conveyer lane (22), the merchandise item stocker (34) having a plurality of compartments defined by rows and tiers and adapted to store therein merchandise items (14) classified by type;

a merchandise item feeder (36) disposed adjacent both the stocker (34) and the rotary conveyer lane (22), the merchandise item feeder (36) being operable to select a merchandise item (14) from those stored in the merchandise item stocker (34) and to transfer the selected merchandise item (14) onto the rotary conveyer lane (22), thereby automatically serving the rotary conveyer lane (22) with merchandise items (14);

a detecting means (38) for determining a place on the rotary conveyer lane (22) at which a merchandise item (14) is lacking, and wherein said merchandise item feeder (36) is adapted to replenish said place determined on the rotary conveyer lane (22) with a merchandise item (14) from said merchandise item stocker (34).

43. An apparatus for serving merchandise items in a rotary catering table system as set forth in claim 42, further including:

ID media (62) fitted to conveyer elements (40) forming the rotary conveyer lane (22) as a rotary conveyer, each of the ID media being capable of registering a type of a merchandise item (14);

a measuring means (32) disposed adjacent to the rotary conveyer (22) for measuring the ID media (62);

a detecting means (38) disposed adjacent to the rotary conveyer (22) for determining the presence or absence of a merchandise item on or above each of the conveyer elements (40); and a processing means (70) responsive to the measuring means (32) and the detecting means (38) for determining and indicating which specified types of merchandise items (14) on the rotary conveyer lane (22) are becoming short of supply in number each from a specified number.

44. An apparatus for serving merchandise items in a rotary catering table system as set forth in claim 43, wherein only one of each adjacent pair of the conveyer elements (40) is fitted with an ID medium (62), thereby reducing the number of the ID media (62) used.

45. An apparatus for serving merchandise items in a rotary catering table system as set forth in claim 44, wherein at least some of the conveyer elements are provided with warning lights, and a warning is issued for each type of merchandise items (14) by emitting a light that varies in flickering time interval, number of light emissions or color depending on types of merchandise items (14).

46. An apparatus for serving merchandise items in a rotary catering table system as set forth in claim 45, wherein at least some of the conveyer elements are provided with freshness managing members (48) each being adapted to detect lightness in environment of the rotary catering table and to suspend issuance said warning in a time zone outside of business hours in which the environment is dark.

47. An apparatus for serving merchandise items in a rotary catering table system as set forth in claim 44, further comprising an ID medium (62) fitted to a merchandise item tray (20) having a merchandise item (14) placed thereon, the ID medium having a type, price or allowable lapse of time of the merchandise item (14) registered therein.

48. An apparatus for serving merchandise items in a rotary catering table system as set forth in claim 43, wherein each adjacent pair of the conveyer elements (40) is fitted with a freshness managing member (48) and with a cover member (68) having no freshness managing means attached thereto, respectively, thereby reducing the number of the freshness managing members (48) used.

49. An apparatus for serving merchandise items in a rotary catering table system as set forth in claim 48, wherein at least some of the conveyer elements are provided with warning lights, and a warning is issued for each type of merchandise items (14) by emitting a light that varies in flickering time interval, number of light emissions or color depending on types of merchandise items (14).

50. An apparatus for serving merchandise items in a rotary catering table system as set forth in claim 49, wherein at least some of the conveyer elements are provided with freshness managing members (48) each being adapted to detect lightness in environment of the rotary catering table and to suspend issuance of said warning in a time zone outside of business hours in which the environment is dark.

51. An apparatus for serving merchandise items in a rotary catering table system as set forth in claim 48, further comprising an ID medium (62) fitted to a merchandise item tray (20) having a merchandise item (14) placed thereon, the ID medium having a type, price or allowable lapse of time of the merchandise item (14) registered therein.

52. An apparatus for serving merchandise items in a rotary catering table system as set forth in claim 43, wherein at least some of the conveyer elements are provided with warning lights, and a warning is issued for each type of merchandise items (14) by emitting a light that varies in flickering time interval, number of light emissions or color depending on types of merchandise items (14).

53. An apparatus for serving merchandise items in a rotary catering table system as set forth in claim 52, wherein at least some of the conveyer elements are provided with freshness managing members (48) each being adapted to detect lightness in environment of the rotary catering table and to suspend issuance of said warning in a time zone outside of business hours in which the environment is dark.

54. An apparatus for serving merchandise items in a rotary catering table system as set forth in claim 45, further comprising an ID medium (62) fitted to a merchandise item tray (20) having a merchandise item (14) placed thereon, the ID medium having a type, price or allowable lapse of time of the merchandise item (14) registered therein.

55. An apparatus for serving merchandise items in a rotary catering table system as set forth in claim 42, further including:

freshness managing members fitted to the rotary conveyer lane;

ID media (62) fitted to the freshness managing members, each of the ID media being capable of registering a type of a merchandise item (14);

a measuring means (32) disposed adjacent to the rotary conveyer (22) for measuring the ID media (62);

a detecting means (38) disposed adjacent to the rotary conveyer (22) for determining the presence or absence of a merchandise item on or above each of the freshness managing members (48); and a processing means (70) responsive to the measuring means (32) and the detecting means (38) for determining and indicating which specified types of merchandise items (14) on the rotary conveyer lane (22) are becoming short of supply in number each from a specified number.

56. An apparatus for serving merchandise items in a rotary catering table system as set forth in claim 55, wherein each adjacent pair of the conveyer elements (40) is fitted with a freshness managing member (48) and with a cover member (68) having no freshness managing means attached thereto, respectively, thereby reducing the number of the freshness managing members (48) used.

57. An apparatus for serving merchandise items in a rotary catering table system as set forth in claim 55, wherein the freshness managing members are provided with warning lights, and a warning is issued for each type of merchandise items (14) by emitting a light that varies in flickering time interval, number of light emissions or color depending on types of merchandise items (14).

58. An apparatus for serving merchandise items in a rotary catering table system as set forth in claim 57, wherein each of the freshness managing members (48) is adapted to detect lightness in environment of the rotary catering table and to suspend issuance of said warning in a time zone outside of business hours in which the environment is dark.

59. An apparatus for serving merchandise items in a rotary catering table system as set forth in claim 55, further comprising an ID medium (62) fitted to a merchandise item tray (20) having a merchandise item (14) placed thereon, the ID medium having a type, price or allowable lapse of time of the merchandise item (14) registered therein.

60. An apparatus for serving merchandise items in a rotary catering table system, as set forth in claim 42, wherein the rotary conveyer lane (22) is provided with a merchandise item supply zone (26) to be served with a merchandise item (14) manually by an operator and a merchandise item recovery zone (28) where a merchandise item (14) is recovered that is deteriorating in freshness, the apparatus further comprising:

a first measuring means (32) for determining types of merchandise items (14) with which the supply zone (26) is served and their respective numbers; and a second measuring means (32) for determining types of merchandise items (14) recovered in the recovery zone (28) and their respective numbers, whereby merchandise items (12) turned around on the rotary conveyer lane (22) are managed.

61. An apparatus for serving merchandise items in a rotary catering table system as set forth in claim 42, further comprising an ID medium (62) fitted to a merchandise item tray (20) having a merchandise item (14) placed thereon, the ID medium having a type, price or allowable lapse of time of the merchandise item (14) registered therein.

62. In a rotary catering table system having a rotary conveyer lane (22) disposed in a top area of a base stand (12) and on which merchandise items (14) are conveyed around, an apparatus for serving the rotary conveyer lane with merchandise items, comprising:

a merchandise item stocker (34) disposed adjacent to the rotary conveyer lane (22), the merchandise item stocker (34) having a plurality of compartments defined by rows and tiers and adapted to store therein merchandise items (14) classified by type;

a merchandise item feeder (36) disposed adjacent both the stocker (34) and the rotary conveyer lane (22), the merchandise item feeder (36) being operable to select a merchandise item (14) from those stored in the merchandise item stocker (34) and to transfer the selected merchandise item (14) onto the rotary conveyer lane (22), thereby automatically serving the rotary conveyer lane (22) with merchandise items (14); and wherein the rotary conveyer lane (22) is provided with a merchandise item supply zone (26) to be served with a merchandise item (14) manually by an operator and a merchandise item recovery zone (28) where a merchandise item (14) is recovered that is deteriorating in freshness, the apparatus further comprising:

a first measuring means (32) for determining types of merchandise items (14) with which the supply zone (26) is served and their respective numbers; and a second measuring means (32) for determining types of merchandise items (14) recovered in the recovery zone (28) and their respective numbers, whereby merchandise items (12) turned around on the rotary conveyer lane (22) are managed.

63. An apparatus for serving merchandise items in a rotary catering table system as set forth in claim 62, further including:

ID media (62) fitted to conveyer elements (40) forming the rotary conveyer lane (22) as a rotary conveyer, each of the ID media being capable of registering a type of a merchandise item (14);

a measuring means (32) disposed adjacent to the rotary conveyer (22) for measuring the ID media (62);

a detecting means (38) disposed adjacent to the rotary conveyer (22) for determining the presence or absence of a merchandise item on or above each of the conveyer elements (40); and a processing means (70) responsive to the measuring means (32) and the detecting means (38) for determining and indicating which specified types of merchandise items (14) on the rotary conveyer lane (22) are becoming short of supply in number each from a specified number.

64. An apparatus for serving merchandise items in a rotary catering table system as set forth in claim 62, further including:

ID media (62) fitted to freshness managing members, each of the ID media being capable of registering a type of a merchandise item (14);

a measuring means (32) disposed adjacent to the rotary conveyer (22) for measuring the ID media (62);

a detecting means (38) disposed adjacent to the rotary conveyer (22) for determining the presence or absence of a merchandise item on or above each of the freshness managing members (48); and a processing means (70) responsive to the measuring means (32) and the detecting means (38) for determining and indicating which specified types of merchandise items (14) on the rotary conveyer lane (22) are becoming short of supply in number each from a specified number.

65. An apparatus for serving merchandise items in a rotary catering table system as set forth in claim 62, further comprising an ID medium (62) fitted to a merchandise item tray (20) having a merchandise item (14) placed thereon, the ID medium having a type, price or allowable lapse of time of the merchandise item (14) registered therein.

66. In a rotary catering table system having a rotary conveyer lane (22) disposed in a top area of a base stand (12) and on which merchandise items (14) are conveyed around, an apparatus for serving merchandise items, including:

freshness managing members (48) fitted to the rotary conveyer lane (22), the freshness managing members (48) being each operable for actuation upon supply with a merchandise item (14) for measuring time elapsing for the merchandise item (14) after supply and each operable to issue a warning upon a predetermined lapse of time after the supply, thereby alerting to the presence of a merchandise item (14) that is deteriorating in freshness.

67. An apparatus for serving merchandise items in a rotary catering table system as set forth in claim 66, wherein said warning is issued for each type of merchandise items (14) by emitting a light that varies in flickering time interval, number of light emissions or color depending on types of merchandise items (14).

68. An apparatus for serving merchandise items in a rotary catering table system as set forth in claim 67, wherein each of the freshness managing members (48) is adapted to detect lightness in environment of the rotary catering table and to suspend issuing said warning in a time zone outside of business hours in which the environment is dark.

69. An apparatus for serving merchandise items in a rotary catering table system as set forth in claim 67, further comprising an ID medium (62) fitted to a merchandise item tray (20) having a merchandise item (14) placed thereon, the ID medium having a type, price or allowable lapse of time of the merchandise item (14) registered therein.

70. An apparatus for serving merchandise items in a rotary catering table system as set forth in claim 66, wherein each of the freshness managing members (48) is adapted to detect lightness in environment of the rotary catering table and to suspend issuing said warning in a time zone outside of business hours in which the environment is dark.

71. An apparatus for serving merchandise items in a rotary catering table system as set forth in claim 70, further comprising an ID medium (62) fitted to a merchandise item tray (20) having a merchandise item (14) placed thereon, the ID medium having a type, price or allowable lapse of time of the merchandise item (14) registered therein.

72. An apparatus for serving merchandise items in a rotary catering table system as set forth in claim 66, further including:

ID media (62) fitted to conveyer elements (40) forming the rotary conveyer lane (22) as a rotary conveyer, each of the ID media being capable of registering a type of a merchandise item (14);

a measuring means (32) disposed adjacent to the rotary conveyer (22) for measuring the ID media (62);

a detecting means (38) disposed adjacent to the rotary conveyer (22) for determining the presence or absence of a merchandise item on or above each of the conveyer elements (40); and a processing means (70) responsive to the measuring means (32) and the detecting means (38) for determining and indicating which specified types of merchandise items (14) on the rotary conveyer lane (22) are becoming short of supply in number each from a specified number.

73. An apparatus for serving merchandise items in a rotary catering table system as set forth in claim 66, further including:

ID media (62) fitted to the freshness managing members, each of the ID media being capable of registering a type of a merchandise item (14);

a measuring means (32) disposed adjacent to the rotary conveyer (22) for measuring the ID media (62);

a detecting means (38) disposed adjacent to the rotary conveyer (22) for determining the presence or absence of a merchandise item on or above each of the freshness managing members (48); and a processing means (70) responsive to the measuring means (32) and the detecting means (38) for determining and indicating which specified types of merchandise items (14) on the rotary conveyer lane (22) are becoming short of supply in number each from a specified number.

74. An apparatus for serving merchandise items in a rotary catering table system as set forth in claim 66, further comprising an ID medium (62) fitted to a merchandise item tray (20) having a merchandise item (14) placed thereon, the ID medium having a type, price or allowable lapse of time of the merchandise item (14) registered therein.

75. In a rotary catering table system having a rotary conveyer lane (22) disposed in a top area of a base stand (12) and on which merchandise items (14) are conveyed around, an apparatus for serving the rotary conveyer lane with merchandise items, comprising:

a merchandise item stocker (34) disposed adjacent to the rotary conveyer lane (22), the merchandise item stocker (34) having a plurality of compartments defined by rows and tiers and adapted to store therein merchandise items (14) classified by type;

a merchandise item feeder (36) disposed adjacent both the stocker (34) and the rotary conveyer lane (22), the merchandise item feeder (36) being operable to select a merchandise item (14) from those stored in the merchandise item stocker (34) and to transfer the selected merchandise item (14) onto the rotary conveyer lane (22), thereby automatically serving the rotary conveyer lane (22) with merchandise items (14); and an ID medium (62) fitted to a merchandise item tray (20) having a merchandise item (14) placed thereon, the ID medium having a type, price or allowable lapse of time of the merchandise item (14) registered therein.

* * * * *